US012042004B2

(12) United States Patent
Bruno

(10) Patent No.: US 12,042,004 B2
(45) **Date of Patent: *Jul. 23, 2024**

(54) ARTICLES OF FOOTWEAR TRANSITIONAL BETWEEN A FOOT INSERTION OR REMOVAL CONFIGURATION AND A FOOT SUPPORTING CONFIGURATION

(71) Applicant: Converse Inc., Boston, MA (US)

(72) Inventor: Stephen N. Bruno, Wellesley, MA (US)

(73) Assignee: Converse Inc., Boston, MA (US)

( * ) Notice: Subject to any disclaimer, the term of this patent is extended or adjusted under 35 U.S.C. 154(b) by 66 days.

This patent is subject to a terminal disclaimer.

(21) Appl. No.: 17/401,686

(22) Filed: Aug. 13, 2021

(65) Prior Publication Data

US 2021/0368915 A1 Dec. 2, 2021

Related U.S. Application Data

(62) Division of application No. 15/920,731, filed on Mar. 14, 2018, now Pat. No. 11,154,115.

(Continued)

(51) Int. Cl.
*A43B 13/14* (2006.01)
*A43B 11/00* (2006.01)

(Continued)

(52) U.S. Cl.
CPC ..... *A43B 13/141* (2013.01); *A43B 11/00* (2013.01); *A43B 13/16* (2013.01); *A43B 13/188* (2013.01);

(Continued)

(58) Field of Classification Search
CPC ..... A43B 13/141; A43B 11/00; A43B 13/16; A43B 21/32; A43B 13/04; A43B 13/188;

(Continued)

(56) References Cited

U.S. PATENT DOCUMENTS 171,301 A 12/1875 McKee
474,574 A 5/1892 Bruzon (Continued)

FOREIGN PATENT DOCUMENTS

CN 101600363 A 12/2009
CN 102595952 B 4/2015

(Continued)

OTHER PUBLICATIONS

English machine translation of WO 03/039,283 A1. Via espacenet.com. Translation performed on Aug. 17, 2023. (Year: 2003).*

(Continued)

*Primary Examiner* — Jameson D Collier
(74) *Attorney, Agent, or Firm* — Banner & Witcoff, Ltd.

(57) ABSTRACT

Foot support systems (and articles of footwear including them) include a midfoot flex component, such as a bi-stable spring element, that moves the article of footwear/sole structure/foot support component/midfoot flex component between an open position/foot insertion or removal configuration and a closed position/foot supporting configuration and vice versa.

20 Claims, 18 Drawing Sheets

Related U.S. Application Data

(60) Provisional application No. 62/473,229, filed on Mar. 17, 2017.

(51) Int. Cl.

| | |
|---|---|
| ***A43B 13/16*** | (2006.01) |
| ***A43B 13/18*** | (2006.01) |
| ***A43B 21/32*** | (2006.01) |
| ***A43B 23/02*** | (2006.01) |
| ***A43C 11/00*** | (2006.01) |
| *A43B 13/04* | (2006.01) |

(52) U.S. Cl.
CPC ..... *A43B 13/189* (2013.01); *A43B 21/32* (2013.01); *A43B 23/0295* (2013.01); *A43C 11/00* (2013.01); *A43C 11/008* (2013.01); *A43B 13/04* (2013.01)

(58) Field of Classification Search
CPC ... A43B 13/189; A43B 23/0295; A43B 13/20; A43B 3/24; A43B 11/02; A43B 13/145; A43B 7/141; A43B 7/142; A43B 7/1425; A43B 7/1445
USPC ..... 36/138, 50.1, 102, 103, 31, 91, 58.5
See application file for complete search history.

(56) References Cited

U.S. PATENT DOCUMENTS

| | | | | |
|---|---|---|---|---|
| 537,627 | A | 4/1895 | Bixby et al. | |
| 955,337 | A | 4/1910 | Lawlor | |
| 2,252,315 | A | 8/1941 | Doree | |
| 2,357,980 | A | 9/1944 | Spiro | |
| 2,450,250 | A | 9/1948 | Napton | |
| 2,452,502 | A * | 10/1948 | Tarbox | A43B 3/24 36/87 |
| 2,815,588 | A | 12/1957 | Ruane | |
| 3,192,651 | A | 7/1965 | Smith | |
| 3,327,410 | A * | 6/1967 | Park, Sr. | A43C 11/008 36/114 |
| 4,095,356 | A | 6/1978 | Robran et al. | |
| 5,036,604 | A | 8/1991 | Rosen | |
| 5,184,410 | A | 2/1993 | Hamilton | |
| 5,481,814 | A | 1/1996 | Spencer | |
| 5,557,866 | A | 9/1996 | Prengler | |
| 5,813,144 | A | 9/1998 | Prengler | |
| 6,189,239 | B1 | 2/2001 | Gasparovic et al. | |
| 6,594,921 | B2 | 7/2003 | Laio et al. | |
| 7,013,586 | B1 * | 3/2006 | Hatfield | A43B 7/20 36/89 |
| 7,137,212 | B2 | 11/2006 | Miller et al. | |
| 7,178,270 | B2 | 2/2007 | Hurd et al. | |
| 7,287,294 | B2 | 10/2007 | Miller et al. | |
| 7,448,148 | B2 | 11/2008 | Martinez et al. | |
| 7,607,242 | B2 | 10/2009 | Karandonis et al. | |
| 7,685,747 | B1 | 3/2010 | Gasparovic et al. | |
| 7,730,639 | B2 | 6/2010 | Hurd et al. | |
| 7,793,438 | B1 | 9/2010 | Busse et al. | |
| 8,161,669 | B2 | 4/2012 | Keating | |
| 8,209,886 | B2 | 7/2012 | Hurd et al. | |
| 8,215,030 | B2 | 7/2012 | Bowen et al. | |
| 8,225,434 | B2 | 7/2012 | Grohe | |
| 8,245,412 | B2 | 8/2012 | Hughes | |
| 8,245,421 | B2 | 8/2012 | Baudouin et al. | |
| 8,365,443 | B2 | 2/2013 | Huynh | |
| 8,635,791 | B2 | 1/2014 | Baudouin et al. | |
| 8,984,770 | B1 | 3/2015 | Piontkowski | |
| 9,089,184 | B1 | 7/2015 | Kiser et al. | |
| 9,265,305 | B2 | 2/2016 | Hatfield et al. | |
| 9,414,640 | B2 | 8/2016 | Nichols | |
| 11,154,115 | B2 * | 10/2021 | Bruno | A43B 13/188 |
| 2006/0174515 | A1 | 8/2006 | Wilkinson | |
| 2008/0168683 | A1 | 7/2008 | Keating | |
| 2010/0251565 | A1 | 10/2010 | Litchfield et al. | |
| 2010/0319216 | A1 | 12/2010 | Grenzke et al. | |
| 2012/0079746 | A1 | 4/2012 | Ferreira et al. | |
| 2013/0326910 | A1 | 12/2013 | Bock | |
| 2014/0298687 | A1 | 10/2014 | Flinterman et al. | |
| 2014/0360049 | A1 | 12/2014 | Panian et al. | |
| 2015/0020416 | A1 | 1/2015 | Wiens | |
| 2015/0216252 | A1 | 8/2015 | Wiens | |
| 2016/0058123 | A1 | 3/2016 | Peyton | |
| 2016/0058128 | A1 | 3/2016 | Dalton | |
| 2016/0073731 | A1 | 3/2016 | Piontkowski et al. | |
| 2016/0302530 | A1 | 10/2016 | Smith et al. | |
| 2017/0042290 | A1 | 2/2017 | Hatfield et al. | |
| 2017/0188656 | A1 | 7/2017 | Carlson et al. | |
| 2017/0224055 | A1 * | 8/2017 | Hooper | A43B 3/126 |

FOREIGN PATENT DOCUMENTS

| | | | | |
|---|---|---|---|---|
| CN | 204888905 | U | 12/2015 | |
| CN | 205963082 | U | 2/2017 | |
| DE | 1931800 | A1 | 3/1970 | |
| EP | 1952715 | A1 | 8/2008 | |
| EP | 2250919 | A2 | 11/2010 | |
| FR | 2994800 | B1 | 3/2015 | |
| GB | 1154145 | A | 6/1969 | |
| WO | WO-03039283 | A1 * | 5/2003 | A43B 11/00 |
| WO | 2004037032 | A1 | 5/2004 | |
| WO | 2006084185 | A1 | 8/2006 | |
| WO | 2010139456 | A1 | 12/2010 | |
| WO | 2014140443 | A1 | 9/2014 | |

OTHER PUBLICATIONS

May 22, 2018—(WO) ISR & WO—App. No. PCT/US18/022356.
Jul. 20, 2021—(EP) ESR—App. No. 21171329.2.
Apr. 12, 2023 (EP) Office Action (App) EP21171329.2, 7 pages.

* cited by examiner

ARTICLES OF FOOTWEAR TRANSITIONAL BETWEEN A FOOT INSERTION OR REMOVAL CONFIGURATION AND A FOOT SUPPORTING CONFIGURATION

RELATED APPLICATION DATA

This application is (a) a divisional of U.S. patent application Ser. No. 15/920,731 titled "Articles of Footwear Transitional Between a Foot Insertion Configuration and a Foot Supporting Configuration" filed Mar. 14, 2018, which application (b) claims priority to and is a non-provisional based on U.S. Provisional Patent Appln. No. 62/473,229, titled "Articles of Footwear Transitional Between a Foot Insertion Configuration and a Foot Supporting Configuration" filed Mar. 17, 2017. Each of U.S. patent application Ser. No. 15/920,731 and U.S. Provisional Patent Appln. No. 62/473,229 is incorporated herein by reference in its entirety.

FIELD OF THE INVENTION

The present invention relates to the field of footwear. Some aspects of the present invention pertain to foot support systems and articles of footwear that include such foot support systems that are easy to put on, easy to secure, and/or easy to remove.

BACKGROUND

Conventional articles of athletic footwear include two primary elements, namely, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure supports and protects the foot and may provide traction and help control potentially harmful foot motion, such as over pronation. General features and configurations of the upper and sole structure are discussed in greater detail below.

The upper forms a void on the interior of the footwear for receiving the foot. The void has the general shape of the foot, and access to the void is provided at an ankle opening. Accordingly, the upper may extend over the instep and toe areas of the foot, along the medial and lateral sides of the foot, and around the heel area of the foot. A lacing system often is incorporated into the upper to allow selective changes to the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture and provide a soft, comfortable feel. The midsole, which traditionally is attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

TERMINOLOGY/GENERAL INFORMATION

First, some general terminology and information is provided that will assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, soccer or football cleats, ski boots, basketball shoes, cross training shoes, etc.), and the like.

The terms "forward" or "forward direction" as used herein, unless otherwise noted or clear from the context, mean at, toward, or in a direction toward a forward-most toe area of the footwear structure or component. The terms "rear," "rearward," or "rearward direction" as used herein, unless otherwise noted or clear from the context, mean at, toward, or in a direction toward a rear-most heel area of the footwear structure or component. The terms "lateral" or "lateral side" as used herein, unless otherwise noted or clear from the context, mean the outside or "little toe" side of the footwear structure or component. The terms "medial" or "medial side" as used herein, unless otherwise noted or clear from the context, mean the inside or "big toe" side of the footwear structure or component. The terms "longitudinal" or "longitudinal direction" as used herein, unless otherwise noted or clear from the context, mean in a front-to-back direction or axial direction of an object. For articles of footwear and/or components thereof, the terms "longitudinal" or "longitudinal direction" may refer to a "heel-to-toe" direction of the articles of footwear and/or components thereof. The terms "transverse" or "transverse direction" as used herein, unless otherwise noted or clear from the context, mean in a side-to-side direction or across an object. For articles of footwear and/or components thereof, the terms "transverse" or "transverse direction" may refer to a "lateral side-to-medial side" direction of the articles of footwear and/or components thereof.

"Bi-stable spring element" means a device that has at least two independent minimal or low stress state positions at which the device can maintain a stable structure. An external force applied to the device may move it from one minimal or low stress state position to another. In at least some examples, no external forces are needed to hold the bi-stable spring element in its various stable positions. As one example, "slap bracelets" or "snap bracelets" are common examples of bi-stable spring elements. At least some "bi-stable spring elements" will transition from a substantially linear longitudinal configuration to a curved, rounded, or wound configuration in its longitudinal direction and vice versa.

In the following description of various example structures in accordance with the invention, reference is made to the accompanying drawings, which form a part hereof, and in which are shown by way of illustration various example foot support structures, components thereof, and articles of footwear in accordance with aspects and examples of the invention. It is to be understood that other specific arrangements of parts and structures may be utilized, and structural and functional modifications may be made without departing from the scope of the present invention. Also, while the terms "top," "bottom," "front," "back," "rear," "side," "underside," "overhead," "over," "under" and the like may be used in this specification to describe various example features and elements of the invention, these terms are used herein as a matter of convenience, e.g., based on the example orientations shown in the figures and/or the orientations in typical use (e.g., orientation when incorporated into an article of footwear supported on the bottom of its sole structure on a horizontal support surface).

BRIEF DESCRIPTION OF THE DRAWINGS

The following Detailed Description will be better understood when read in conjunction with the accompanying drawings in which like reference numerals refer to the same or similar elements in all of the various views in which that reference number appears.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. General Description of Aspects of This Invention

Foot support systems (and articles of footwear including them) include a midfoot flex component, such as a bi-stable spring element, that moves the article of footwear/sole structure/foot support component/midfoot flex component between an open position/foot insertion or removal configuration and a closed position/foot supporting configuration and vice versa. Movement of the midfoot flex component between these positions/configurations may include rotational/pivotal movement of the heel portion of the footwear with respect to the forefoot portion of the footwear about a transverse axis (extending in the medial side-to-lateral side direction) in the midfoot/shank area. The midfoot flex component may form/define the location of motion/axis of rotation or pivot. The midfoot flex component may stably maintain both the open position and the closed position with no external forces applied to it, in at least some examples of this invention.

II. Detailed Description of Specific Examples of This Invention

Figure 1A:
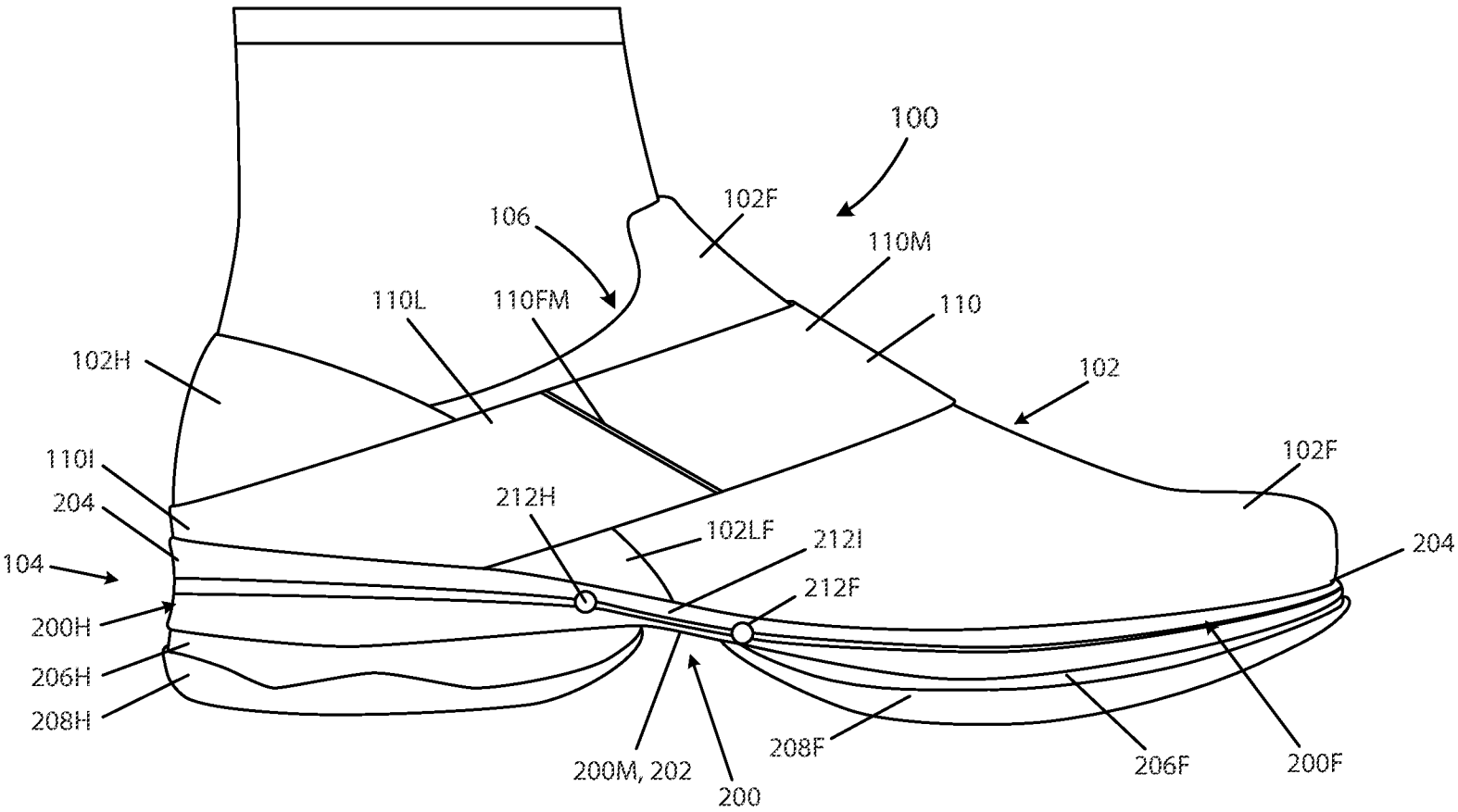
FIGS. 1A through 1C provide side, rear, and exploded views, respectively, of an article of footwear and foot support structures in accordance with at least some examples of this invention.
Figure 1B:
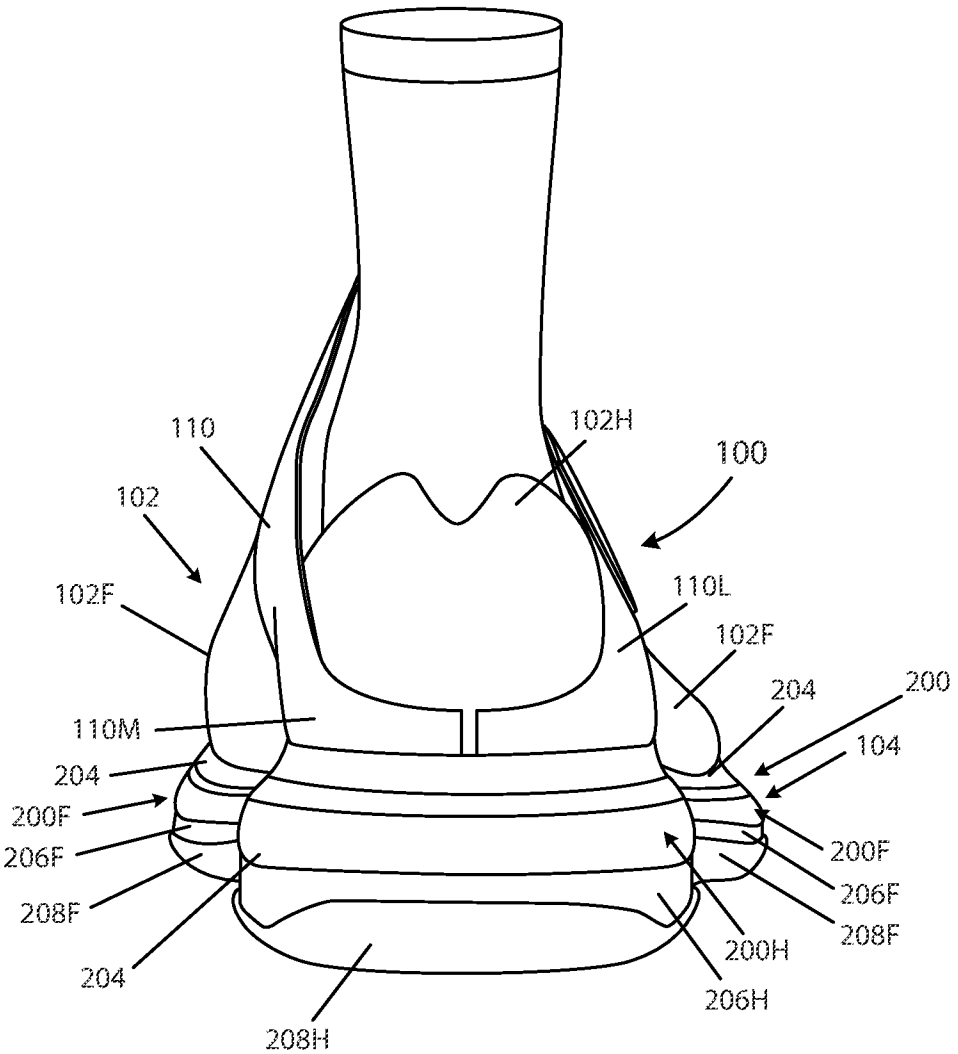
Figure 1C:
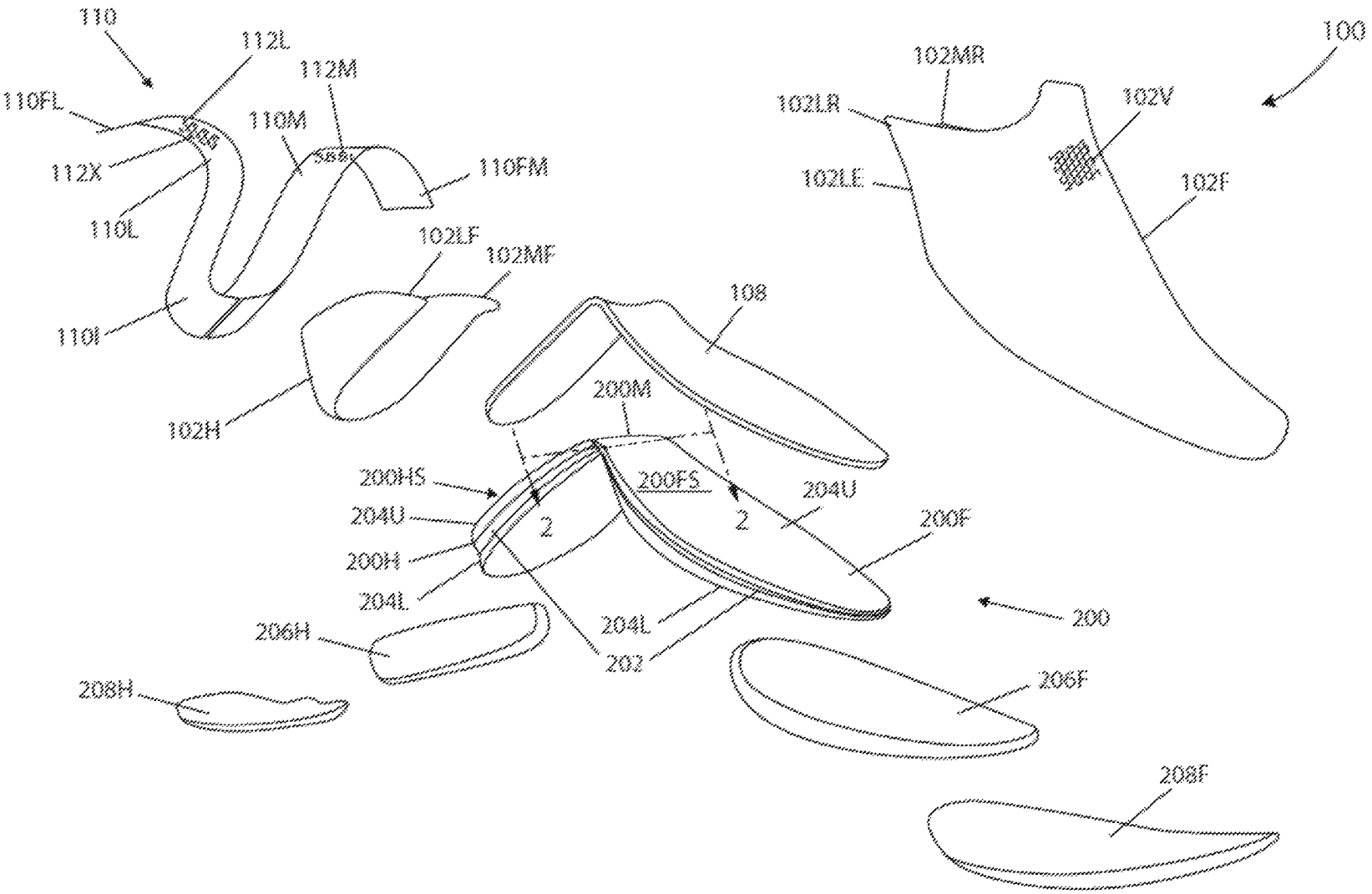

FIGS. 1A through 1C illustrate example features of articles of footwear 100 in accordance with some aspects of this invention. The illustrated article of footwear 100 includes an upper 102 (e.g., a multi-part upper) and a sole structure 104 (e.g., a multi-part sole structure) engaged with the upper 102. The upper 102, optionally together with the sole structure 104, defines a foot-receiving chamber 106 accessible in manners described in more detail below. While FIG. 1A shows the lateral side view of this example article of footwear 100, the medial side of the footwear 100 may include the same or a similar appearance, arrangement, and/or relative arrangement of parts.

More specific features of this example footwear 100 structure are shown in the exploded view of FIG. 1C. As shown, the upper 102 of this example footwear 100 structure includes a forefoot upper component 102F (including a vamp component or an instep covering component), which may be made from one or more parts (and may include a hook-and-loop fastener construction 102V over at least a portion of the vamp/instep covering forefoot upper component 102F). The upper 102 further includes a heel upper component 102H, which also may be made from one or more parts, and in this illustrated example includes a lateral side heel portion and a medial side heel portion joined by a rear heel portion. The heel upper component 102H may include a heel counter or other structure (e.g., formed of a rigid plastic material, such as a thermoplastic polyurethane or other thermoplastic polymer material, a thermosetting polymer material, a polyether block amide polymer, etc.) to support the wearer's heel and/or provide shape to the heel upper component 102H. The forefoot upper component 102F in this illustrated example is not fixedly (permanently) or rigidly engaged directly with the heel upper component 102H, for reasons to be described in more detail below. The upper 102 (including the individual forefoot upper component 102F and the heel upper component 102H) may be made from any desired material(s), including material(s) and/or combinations of materials as are conventionally known and used in the footwear upper art. When made from multiple parts, the parts of the individual forefoot upper component 102F and/or the heel upper component 102H may be engaged in any desired manner, including manners that are conventionally known and used in the footwear arts (e.g., adhesives or cements; stitching; mechanical connectors or fasteners; welding or fusing techniques; etc.).

The forefoot upper component 102F of this example includes a lateral rear upper portion including a lateral rear end 102LR and a medial rear upper portion including a medial rear end 102MR. Additionally, the heel upper component 102H of this example includes a lateral forward upper portion including a lateral forward end 102LF and a medial forward upper portion including a medial forward end 102MF. As will be described in more detail below, when the article of footwear 100 is in a closed position or a foot supporting configuration, e.g., as shown in FIG. 1A, at least a portion of the lateral rear upper portion (e.g., the lateral rear end 102LR and at least a portion of the bottom upper edge 102LE leading up to it) of the forefoot upper component 102F is covered by and/or overlaps with the lateral forward upper portion (e.g., the lateral forward end 102LF) of the heel upper component 102H. Additionally or alternatively, at least a portion of the medial rear upper portion (e.g., the medial rear end 102MR and at least a portion of the bottom edge 102ME leading up to it) of the forefoot upper component 102F is covered by and/or overlaps with the medial forward upper portion (e.g., the medial forward end 102MF) of the heel upper component 102H. In this manner, in the closed position or the foot supporting configuration, the overlapping upper components 102H/102F at the midfoot area enclose the wearer's midfoot and firmly hold the wearer's foot is use. Also, when the article of footwear 100 of this illustrated example is in an open position or a foot insertion or removal configuration (e.g., see FIG. 3A), the lateral rear end 102LR and the medial rear end 102MR are exposed. In this manner, the upper 102 may have a "clamshell" type configuration in which the heel upper component 102H and the forefoot upper component 102F move with respect to one another to open and close about a hinge structure (formed by the midfoot flex component 200M described in more detail below). Alternatively, if desired, when the article of footwear 100 is in an open position or a foot insertion or removal configuration, at least some portion (s) of the lateral rear upper portion and/or the medial rear upper portion (e.g., the lateral rear end 102LR and/or the medial rear end 102MR) of the forefoot upper component 102F may still be covered by and/or overlap with the lateral forward upper portion and/or the medial forward upper portion (e.g., the lateral forward end 102LF and/or the medial forward end 102MF) of the heel upper component 102H to some degree, e.g., but to a lesser degree (e.g., with less surface area of overlap or coverage) than the coverage by and/or overlap provided in the closed position or foot supporting configuration. As other options or alternatives, if desired, the layering order of the heel upper component 102H and the forefoot upper component 102F could be reversed, e.g., so that the lateral rear end 102LR (of the forefoot upper component 102F) lies outside the lateral forward end 102LF (of the heel upper component 102H) and/or so that the medial rear end 102MR (of the forefoot upper component 102F) lies outside the medial forward end 102MF (of the heel upper component 102H), at least when the footwear 100 in in the closed position.

The upper 102 of this example further includes a strobel member/sock liner 108 to at least partially close off the bottom of the upper 102 (and at least partially define the foot-receiving chamber 106). While the strobel member/sock liner 108 may be made from any desired material without departing from this invention, in this illustrated example, the strobel member/sock liner 108 is made from a flexible material (e.g., a textile material, a rubber material, a lightweight foam material, etc.). The strobel member/sock liner 108 of this example is independently engaged with both the forefoot upper component 102F and the heel upper component 102H, e.g., by stitching, adhesives or cements, etc. Alternatively, if desired, separate heel based and forefoot based strobel members/sock liners may be provided (optionally separated by a gap in the midfoot/arch area). The strobel member/sock liner 108 may be made, at least in part, from a stretchable or elastic material, e.g., to support motion about the midfoot flex component 200M, as described in more detail below.

As further shown in FIGS. 1A-1C, this example article of footwear 100 further includes a securing strap 110 for securing the article of footwear 100 to a wearer's foot. Many variations in the securing strap 110 constructions/arrangements are possible without departing from this invention, including the use of securing straps of types that are conventionally known and used in the footwear arts. In this illustrated example, however, the securing strap 110 includes a first free end 110FL (e.g., at the end of a lateral strap portion 110L, which may include a webbing strap), a second free end 110FM (e.g., at the end of a medial strap portion 110M, which may include a webbing strap), and an intermediate portion 110I extending between the first free end 110FL and the second free end 110FM. As shown in FIGS. 1A-1C, the intermediate portion 110I of the securing strap 110 may extend beneath a bottom of the heel upper component 102H (and optionally beneath the strobel member/sock liner 108 at the rear heel area) and/or around a rear heel area of the heel upper component 102H. This intermediate portion 110I of the securing strap 110 may be fixed/permanently secured to the heel upper component 102H and/or the strobel member 108, e.g., by sewing or stitching, by adhesives or cements, etc. In the example of FIGS. 1A-1C, by somewhat cupping the rear and bottom heel areas of the upper 102 (and a wearer's foot), stable engagement, custom fit, and/or adaptable fit of the footwear 100 can be made with the wearer's foot.

The securing strap 110 of this illustrated example is engaged around the upper 102 (and thus around a wearer's foot) as follows. First, the lateral strap portion 110L is pulled around the lateral side and across instep/vamp region of the forefoot upper component 102F, and an interior hook-and-loop fastener 112L on the interior surface of the lateral strap portion 110L releasably engages with the hook-and-loop fastener 102V provided on the instep/vamp region of the forefoot upper component 102F. The lateral strap portion 110L of this example further includes an exterior hook-and-loop fastener 112X on its exterior surface. After the lateral strap portion 110L is secured at the instep/vamp region of forefoot upper component 102F, the medial strap portion 110M is pulled around the medial side and across instep/vamp region of the forefoot upper component 102F and over the lateral strap portion 110L. When pulled to the desired tightness, an interior hook-and-loop fastener 112M on the interior surface of the medial strap portion 110M releasably engages with the exterior hook-and-loop fastener 112X provided on the exterior surface of the lateral strap portion 110L. In this manner, the free end 110FL of the lateral strap portion 110L is at least partially covered (and optionally completely covered) by the medial strap portion 110M. The medial strap portion 110M extends around to the lateral side of the upper 102 in this example structure, as shown in FIG. 1A. This arrangement locks down the foot into the footwear 100. Alternatively, if desired, the hook-and-loop fastener locations could be changed on the strap portions 110L/110M so that the lateral strap portion 110L overlays the free end 110FM of the medial strap portion 110M and so that the medial strap portion 110M releasably engages hook-and-loop fastener 102V. Also, releasable securing mechanisms other than hook-and-loop fasteners may be used for any of these securing mechanisms without departing from this invention, including one or more of snaps, buttons, buckles, and the like. As another option, a lace type securing system also could be used, if desired.

The sole structure 104 of this example article of footwear 100 now will be described in more detail with reference to FIGS. 1A through 2F. One component of this sole structure 104 includes a foot support component 200 that is movable between an open position (or a foot insertion or removal configuration) and a closed position (or a foot supporting configuration). The foot support component 200 of this illustrated example includes a forefoot support component 200F (which may constitute one or more impact force attenuating components), a heel support component 200H (which may constitute one or more impact force attenuating components), and a midfoot flex component 200M connecting and engaging (e.g., connected to, integrally formed with, etc.) the forefoot support component 200F and the heel support component 200H. If desired, the foot support component 200 may be formed as a multi-part structure, e.g., with a central rigid plate 202 (e.g., formed from a high density and/or hard material for stability, such as a TPU or other thermoplastic polymer material, a thermosetting polymer material, a polyether block amide polymer, a metal or metal alloy material, etc.) that may have at least one surface (and optionally both surfaces) at least partially covered with an impact force attenuating component 204 (such as EVA or polyurethane foam having a lower density than the rigid plate 202 to provide a soft, comfortable feel, impact force attenuation, etc.). In the example structure of FIG. 1C, an upper foam component 204U is provided above the top surface of rigid plate 202, and this upper foam component 204U extends to form at least part of the heel support component 200H and/or the forefoot support component 200F. Additionally or alternatively, a lower foam component 204L is provided below the bottom surface of rigid plate 202, and this lower foam component 204L extends to form at least part of the heel support component 200H and/or the forefoot support component 200F.

The rigid plate component 202 of this illustrated example forms at least a portion of the midfoot flex component 200M of foot support component 200. Either or both of the upper foam component 204U and/or the lower foam component 204L may extend through the midfoot region and at least partially overlap the rigid plate 202, including the portion of the rigid plate 202 that forms the midfoot flex component 200M.

Alternatively, the upper foam component 204U and the lower foam component 204L may be formed as separate parts so as not to extend continuously through the midfoot region and/or to not overlap the portion of the rigid plate 202 that forms the midfoot flex component 200M. In other words, separate forefoot and heel oriented upper foam components 204U and/or lower foam components 204L may be provided, if desired, without departing from at least some aspects of this invention, and the rigid plate 202 then may be at least partially exposed in the arch/shank area of the sole structure 104. As another potential option or alternative, the rigid plate 202 may extend in a longitudinal direction of the sole structure 104 primarily just through the arch/midfoot region of the sole structure 104 (e.g., from 0.5 to 6 inches, and in some examples, from 0.75 to 5 inches or even 1 to 4 inches) and be engaged with: (a) a heel support component 200H (e.g., made from one or more of a foam material 204, a fluid-filled bladder, etc.) at a heel end thereof and/or (b) a forefoot support component 200F (e.g., made from one or more of a foam material 204, a fluid-filled bladder, etc.) at the forefoot end thereof.

The foot support component 200 of this example is engaged with the upper 102 (e.g., with one or more of heel upper component 102H, forefoot upper component 102F, strobel member/sockliner 108, and/or securing strap 110, etc.) in any desired manner, including in manners conventionally known and used in the footwear arts (e.g., by one or more of adhesives or cements, stitching, by mechanical fasteners, etc.). The foot support component 200 will be engaged with the upper 102 in a manner so as to support transition of the midfoot flex component 200M (e.g., at least rigid plate 202), the foot support component 200, the sole structure 104, and/or the article of footwear 100 between an open position (or a foot insertion or removal configuration) and a closed position (or a foot supporting configuration), as will be described in more detail below in conjunction with FIGS. 2A-4C.

As further potential options or features for the sole structure 104, FIGS. 1A-1C further illustrate that this example sole structure 104 includes one or more impact-force attenuating elements engaged with a bottom surface of the foot support component 200. More specifically, as shown in these figures, the sole structure 104 further may include one or more fluid-filled bladder elements to provide additional impact force attenuation. In this specifically illustrated example, a forefoot fluid-filled bladder element 206F (e.g., which may be considered as part of the forefoot support component 200F) and a separate heel fluid-filled bladder element 206H (e.g., which may be considered as part of the heel support component 200H) are provided. Alternatively, if desired, one or both of the forefoot fluid-filled bladder element 206F and the heel fluid-filled bladder element 206H may be replaced by a foam component, a spring component, or other impact force attenuating element. As yet other options or alternatives, if desired, one or both of the forefoot fluid-filled bladder element 206F and the heel fluid-filled bladder element 206H may be replaced by multiple fluid-filled bladder elements, a combination of fluid-filled bladder elements and other impact force attenuating components (e.g., foam), a single fluid-filled bladder element, etc.

Accordingly, as shown in FIG. 1C, the forefoot support component 200F of this example includes an upper forefoot support portion 204U defining a forefoot plantar support surface 200FS and a lower forefoot support portion 204L located below the upper forefoot support portion 204U, and the heel support component 200H includes an upper heel support portion 204U defining a heel plantar support surface 200HS and a lower heel support portion 204L located below the upper heel support portion 204U. The forefoot fluid-filled bladder element 206F is engaged with the lower forefoot support portion 204L of the forefoot support component 200F, and the heel fluid-filled bladder element 206H is engaged with the lower heel support portion 204L of the heel support component 200H. The fluid-filled bladder elements 206F and 206H may be engaged with the foot support component 200 (and may be considered to constitute a part of the foot support component 200) in any desired manner, such as by one or more of cements or adhesives, mechanical connectors, etc.

While any desired fluid-filled bladder construction may be used, in at least some examples of this invention, either or both of fluid-filled bladders 206H and/or 206F may include various features to control their shape, such as internal welds, internal tensile elements, or the like, e.g., to provide a relatively flat or thin shape.

This example sole structure 104 further includes a forefoot outsole component 208F engaged with the forefoot support component 200F (e.g., engaged with one or more of the lower foam portion 204L in the forefoot support area, the forefoot fluid-filled bladder element 206F (if any), etc.), and a heel outsole component 208H engaged with the heel support component 200H (e.g., engaged with one or more of the lower foam portion 204L in the heel support area, the heel fluid-filled bladder element 206H (if any), etc.). The forefoot outsole component 208F and/or the heel outsole component 208H protect more fragile impact force attenuating components (e.g., fluid-filled bladder elements 206H and/or 206F), foam components 204L, or the like). Also, the forefoot outsole component 208F and/or the heel outsole component 208H may include traction elements, treads, ridges, grooves, and/or other features at their respective ground-contacting surfaces to improve the user's contact with/traction on the ground. While the illustrated example structures show forefoot outsole component 208F and heel outsole component 208H as separate, individual structures, other options are possible. For example, either or both of forefoot outsole component 208F and/or heel outsole component 208H may be made from two or more parts, or forefoot outsole component 208F and heel outsole component 208H may constitute portions of a single outsole component. The outsole component(s) 208F and 208H may be made from rubber, thermoplastic polyurethane, and/or other appropriate material, including materials conventionally known and used in the footwear arts. Also, either or both of the outsole component(s) 208F and 208H may be formed as cupsole structures that include an interior chamber surrounded by side walls to receive at least some of the structures to which they are engaged, e.g., to help protect at least some portions of the side edges of the component(s) to which they are engaged (e.g., forefoot fluid-filled bladder element 206F, heel fluid-filled bladder element 206H, foam components, etc.).

While other arrangements are possible, in this illustrated example, heel support and impact force attenuation are provided by separate components (e.g., heel fluid-filled bladder 206H, heel outsole component 208H, heel support component 200H, etc.) than those used to provide forefoot support and impact force attenuation (e.g., forefoot fluid-filled bladder 206F, forefoot outsole component 208F, forefoot support component 200F, etc.). In effect, the heel and forefoot components are provided as separate forefoot and heel "pods" of support/impact force attenuation. These separate heel and forefoot combinations or "pods" are joined (e.g., integrally formed with, attached to, etc.) by midfoot flex component 200M, which may include a rigid plate 202 or other structure (e.g., a bi-stable hinge or spring element) capable of transitioning between (a) an open position/foot insertion or removal configuration and (b) a closed position/foot supporting configuration. The separation, arrangement, and combination of parts (e.g., into the pods as mentioned above) are well suited for providing the features and functions described below.

Aspects and features of the foot support component 200, and particularly the midfoot flex component 200M, will be described in more detail below, in conjunction with FIGS. 1A-2F. A central portion of the midfoot flex component 200M in this sole structure 104 (located in the arch/shank area) flexes between: (a) an open position (e.g., as shown in FIG. 1C) in which the midfoot flex component 200M is arched or curved in the longitudinal direction (or heel-to-toe direction) of the sole structure 104 and/or the article of footwear 100 and (b) a closed position (e.g., as shown in FIGS. 1A and 1B) in which the midfoot flex component 200M is flat or substantially straight in the longitudinal direction (or heel-to-toe direction) of the sole structure 104 and/or the article of footwear 100. In at least some examples of this invention, the midfoot flex component 200M may constitute a bi-stable spring element. When formed as or to include a bi-stable spring element, the bi-stable spring element may extend, for example, from 0.5 to 6 inches, and in some examples, from 0.75 to 5 inches or even 1 to 4 inches along the longitudinal direction of the sole structure 104 through the midfoot/arch area of the sole structure. The bi-stable spring element (or other midfoot flex component 200M) may constitute the sole foot support component through the midfoot/arch/shank region (optionally only combined with a strobel/sock liner component 108 to close off the bottom of the upper 102).

Figure 2B:
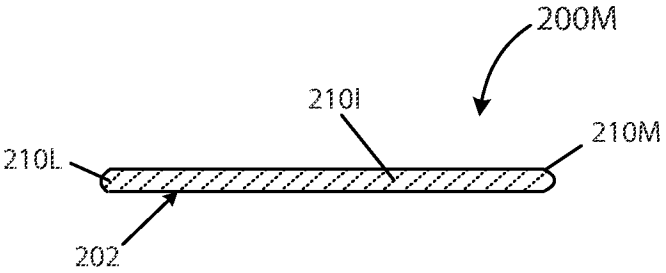
FIGS. 2A through 2F provide transverse cross sectional views of example midfoot flex components in various positions and configurations in accordance with at least some examples of this invention.
Figure 2A:
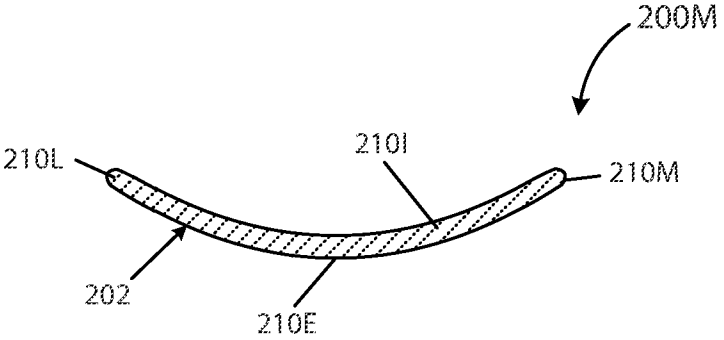
Figure 2C:
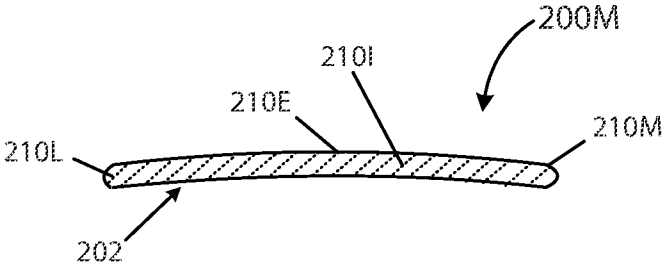

FIGS. 2A through 2F provide transverse cross sectional views of midfoot flex components 200M in some examples and configurations in accordance with this invention, e.g., with the cross section taken at a flex or bend portion of a foot support component 200 and/or midfoot flex component 200M (as shown by line 2-2 in FIG. 1C). FIG. 2A illustrates a transverse cross sectional view of an example midfoot flex component 200M in a closed position or a foot supporting configuration, e.g., as shown in FIGS. 1A and 1B in accordance with this example of the invention. As shown in FIG. 2A, the midfoot flex component 200M of this example includes a medial side edge 210M, a lateral side edge 210L, and an intermediate portion 210I extending between the lateral side edge 210L and the medial side edge 210M. Unless otherwise noted or clear from the context, the "intermediate portion" 210I in a side-to-side or transverse direction of a midfoot flex component 200M may be considered as the central 50% of the midfoot flex component 200M measured in the transverse (side-to-side) direction, the "lateral side" of a midfoot flex component 200M may be considered as the lateral-most 25% of the midfoot flex component 200M (from the lateral side edge 210L inward to the intermediate portion 210I) measured in the transverse (side-to-side) direction, and the "medial side of a midfoot flex component 200M may be considered as the medial-most 25% of the midfoot flex component 200M (from the medial side edge 210M inward to the intermediate portion 210I) measured in the transverse (side-to-side) direction. FIGS. 2B and 2C illustrate alternative transverse cross sectional views of this same example midfoot flex component 200M in an open position or a foot insertion or removal configuration, e.g., as shown in FIG. 1C in accordance with this example of the invention.

As shown by FIG. 2A, in the closed position, at least a portion of the midfoot flex component 200M (e.g., at least the intermediate portion 210I) has a transverse cross sectional shape extending in a direction from the medial side edge 210M to the lateral side edge 210L that curves in a first direction from a local extrema 210E located in the intermediate portion 210I. More specifically, in this illustrated example, the intermediate portion 210I curves upward from local extrema 210E (the lowest point of the curved surface extending in the transverse direction). In this closed position/foot supporting configuration of FIG. 2A, the midfoot flex component 200M extends into the page of FIG. 2A (toward the heel support component 200H) and out of the page of FIG. 2A (toward the forefoot support component 200F) in a substantially straight line longitudinal direction (the longitudinal direction of the sole structure 104, the article of footwear 100, and the midfoot flex component 200M extends into and out of the page of FIG. 2A). Note also the configuration of midfoot flex component 200M shown in FIGS. 1A, 3E, 3F, and 4A. This straight line longitudinal orientation also tends to provide lateral rigidity and stability when the footwear 100 is in the closed position/foot supporting configuration.

In the open position of the example of FIG. 2B, on the other hand, at least the same portion of the midfoot flex component 200M of this example (e.g., at least the intermediate portion 210I) has a transverse cross sectional shape extending in the direction from the medial side edge 210M to the lateral side edge 210L that is substantially flat.

Alternatively, as shown in the open position of the example of FIG. 2C, in some midfoot flex component 200M constructions, this same portion of the midfoot flex component 200M (e.g., at least the intermediate portion 210I) may have a transverse cross sectional shape extending in the direction from the medial side edge 210M to the lateral side edge 210L that curves in a second direction from a local extrema 210E located in the intermediate portion 210I, wherein the second direction is opposite from the first direction. More specifically, in this illustrated example, the intermediate portion 210I curves downward from local extrema 210E (the highest point of the curved surface extending in the transverse direction). In these open positions/foot insertion or removal configurations of FIGS. 2B and 2C, the midfoot flex component 200M extends into the page of FIGS. 2B and 2C (toward the heel support component 200H) in a downwardly curved direction and out of the page of FIGS. 2B and 2C (toward the forefoot support component 200F) in a downwardly curved direction. Note the downward curvature of midfoot flex component 200M toward plantar support surfaces 200HS and 200FS in FIG. 1C. Thus, in the open position or foot insertion/removal configuration, the midfoot flex component 200M curves in the longitudinal direction of the sole structure 104, the article of footwear 100, and the midfoot flex component 200M, e.g., as shown in FIGS. 1C, 3A-3D, 4B, and 4C.

Figure 3A:
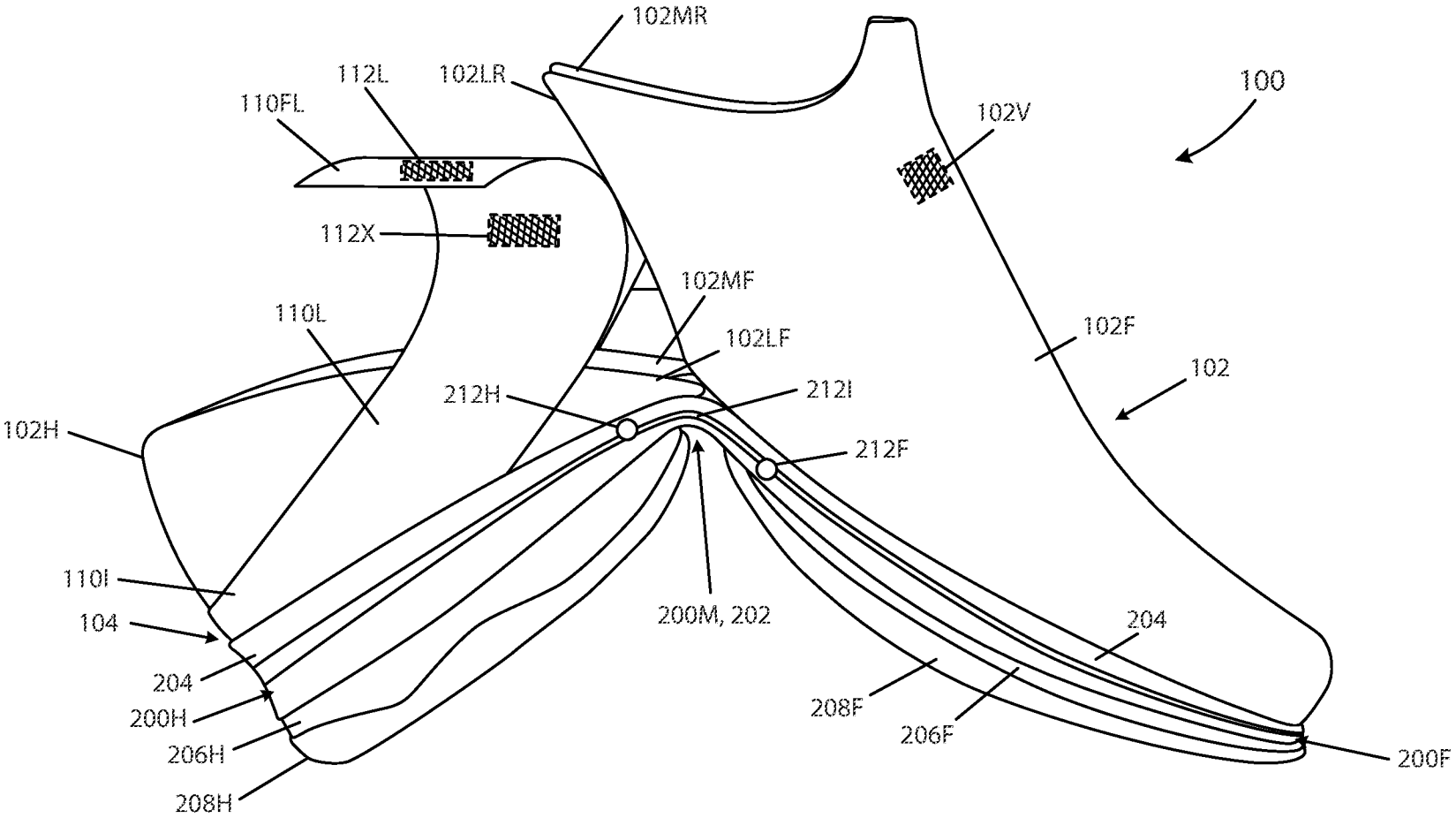
FIGS. 3A through 3F illustrate features of a footwear securing process for articles of footwear in accordance with some aspects of this invention.

FIGS. 1A and 3A further illustrate the midfoot flex component 200M (which may constitute a bi-stable spring element) in its closed position/foot supporting configuration (FIG. 1A) and its open position/foot insertion or removal configuration (FIG. 3A). As shown in these figures, the midfoot flex component 200M may be considered as having a first end 212H, a second end 212F, and a front-to-back intermediate portion 212I extending between the first end 212H and the second end 212F in the longitudinal direction. In this illustrated example, the first end 212H is located closer to the heel support component 200H than is the second end 212F and the second end 212F is located closer to the forefoot support component 200F than is the first end 212H. In this manner, the front-to-back intermediate portion 212I of the midfoot flex component 200M extends from the first end 212H to the second end 212F in a longitudinal direction of the sole structure 104/article of footwear 100/foot support component 200. In the closed position/foot supporting configuration (e.g., a first stable condition or configuration of a bi-stable spring element), as shown in FIG. 1A, the front-to-back intermediate portion 212I extends in a substantially linear direction in the direction from the first end 212H toward the second end 212F. In the open position/foot insertion or removal configuration (e.g., a second stable condition or configuration of a bi-stable spring element), however, as shown in FIG. 3A, the front-to-back intermediate portion 212I is curved in the direction from the first end 212H toward the second end 212F (e.g., curved downward from the transverse axial location of flex in the midfoot flex component 200M).

Figure 2D:
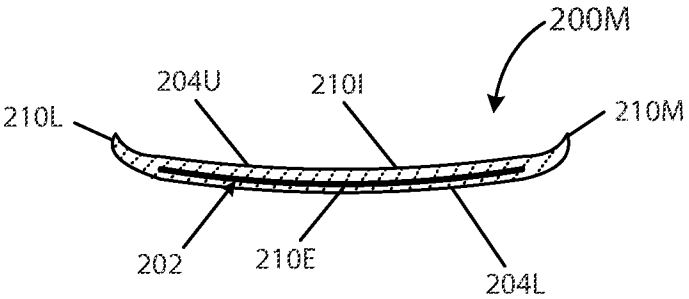
Figure 2F:
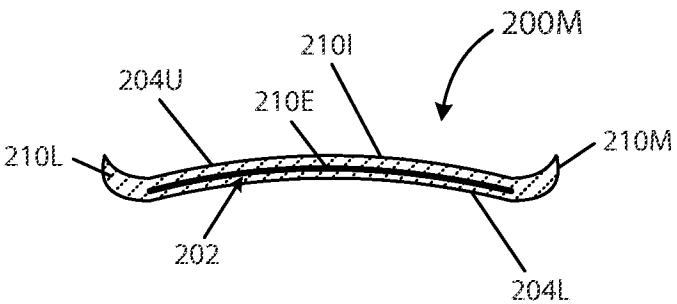
Figure 2E:
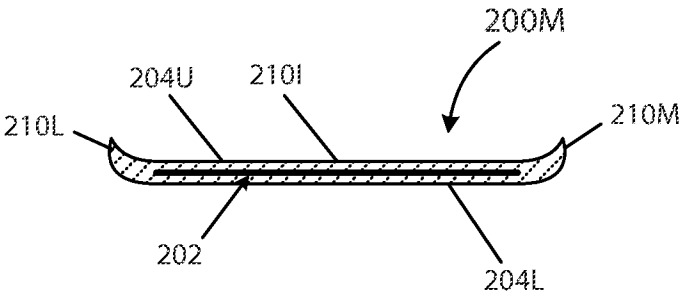

FIGS. 2D through 2F provide transverse cross sectional views of other example midfoot flex components 200M similar to the views of FIGS. 2A through 2C, respectively, but in the examples of FIGS. 2D through 2F, the intermediate portion 210I of the midfoot flex component 200M includes a rigid plate 202 having its top surface covered by an upper foam (or rubber/silicone) component 204U and its bottom surface covered by a lower foam (or rubber/silicone) component 204L, e.g., as described above. Thus, the rigid plate 202 of the midfoot flex component 200M (e.g., a bi-stable spring element) in this example structure 200 is embedded in (e.g., covered, coated, etc.) by foam or rubber/silicone component(s) 204U and/or 204L. Also, in this structure, the extreme side edges 210L and/or 210M may remain curved upward in the closed position (FIG. 2D) or in the open positions (FIGS. 2E and 2F), even though the central rigid plate 202 curves in substantially the same manners as described above for the embodiment of FIGS. 2A-2C. In some examples, the midfoot flex components 200M of FIGS. 2D-2F will constitute a bi-stable spring element as component 202 covered or coated by an exterior sheath or coating layer(s) 2024U/204L that may be made from a rubber, plastic, or other material.

Figure 3B:
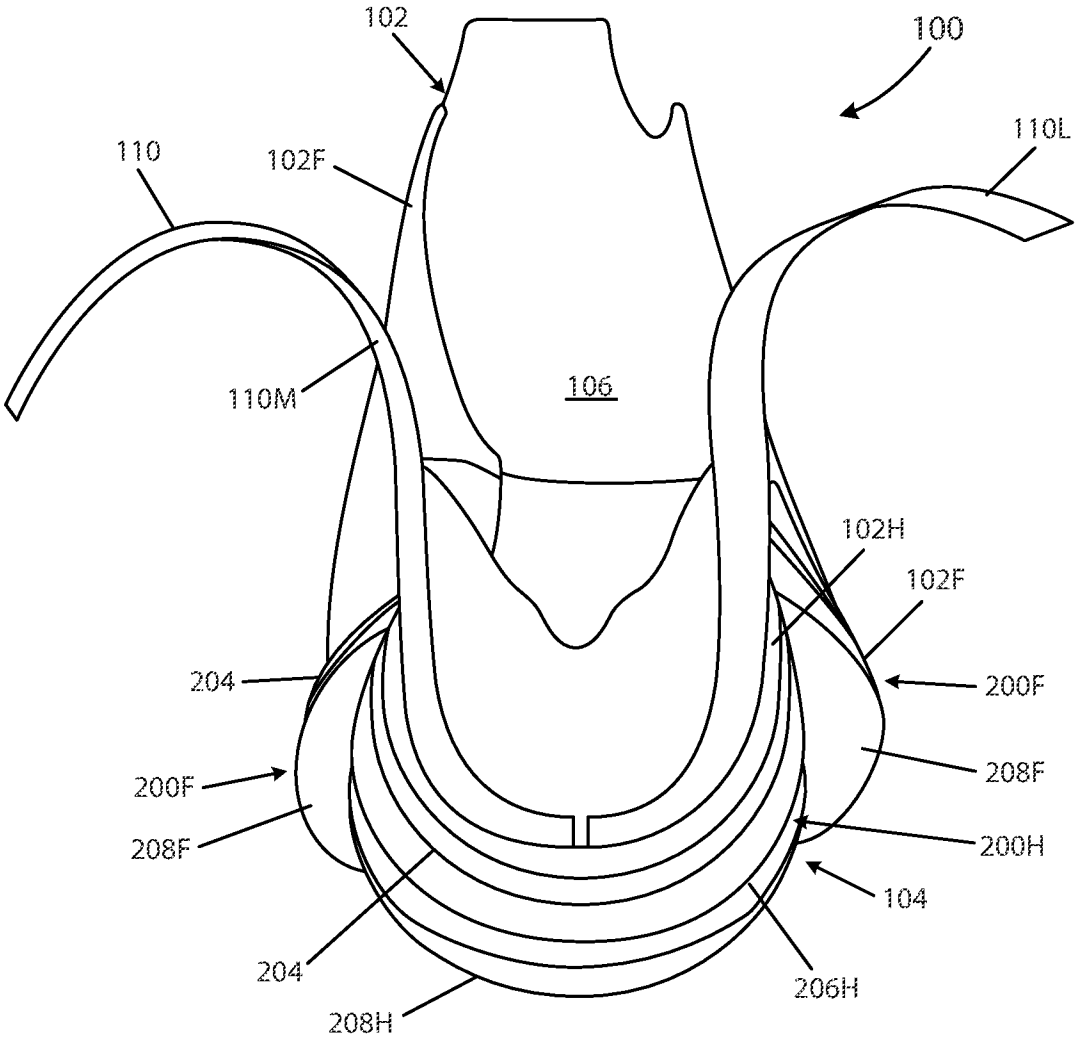

Operation of articles of footwear 100 and sole structures 104 in accordance with at least some examples of this invention will be described with reference to FIGS. 3A-4C. FIGS. 3A and 3B show this example article of footwear 100 empty and in the open position (i.e., the foot insertion or removal configuration). In this position/configuration, the midfoot flex component 200M (e.g., a bi-stable spring element) will be in the configuration shown, for example, in one of FIGS. 2B, 2C, 2E, and 2F. In at least some examples of this invention, the midfoot flex component 200M will be maintained stably in this open position/foot insertion or removal configuration even if no external forces are applied to the footwear 100 structure.

Figure 3C:
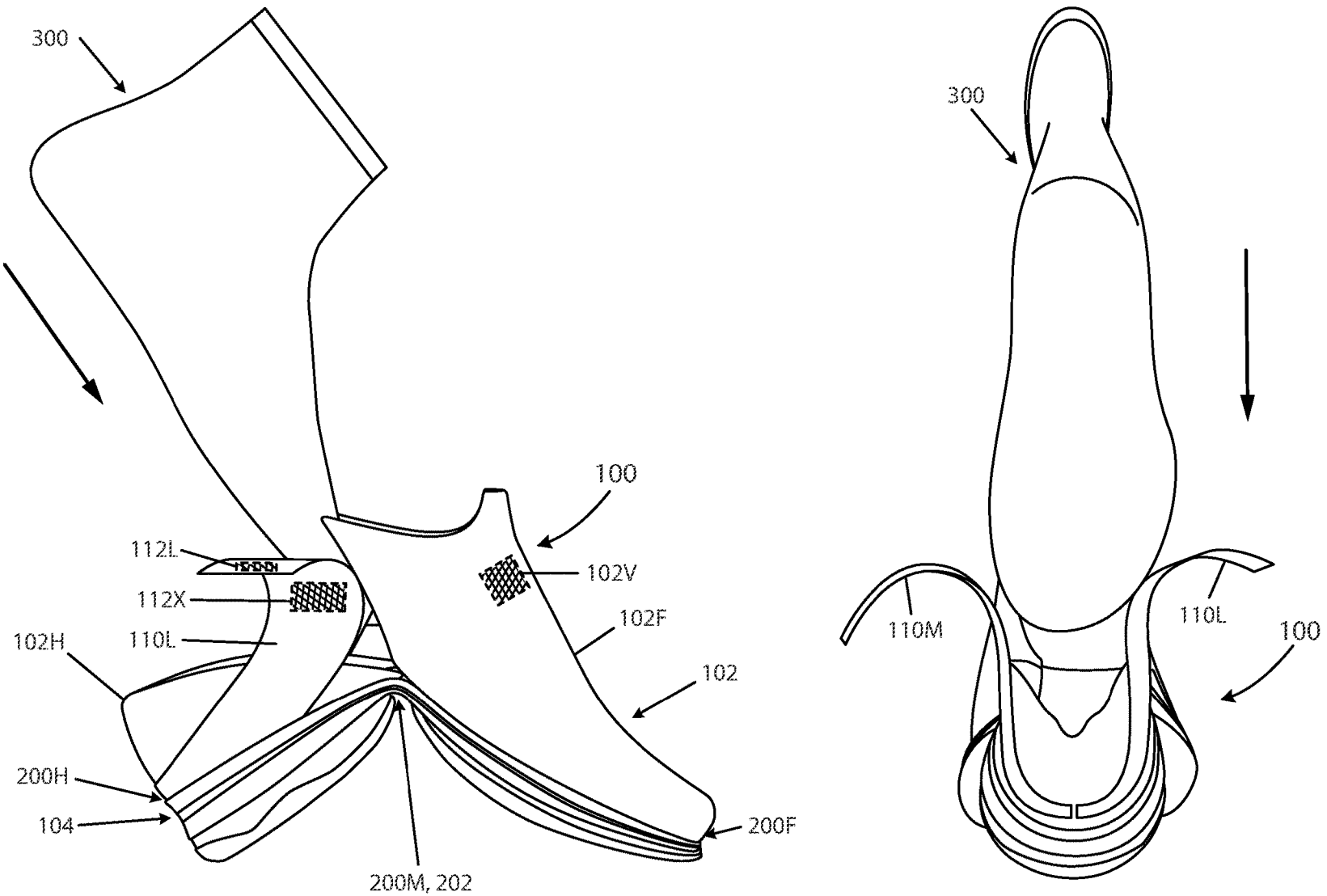
Figure 3D:
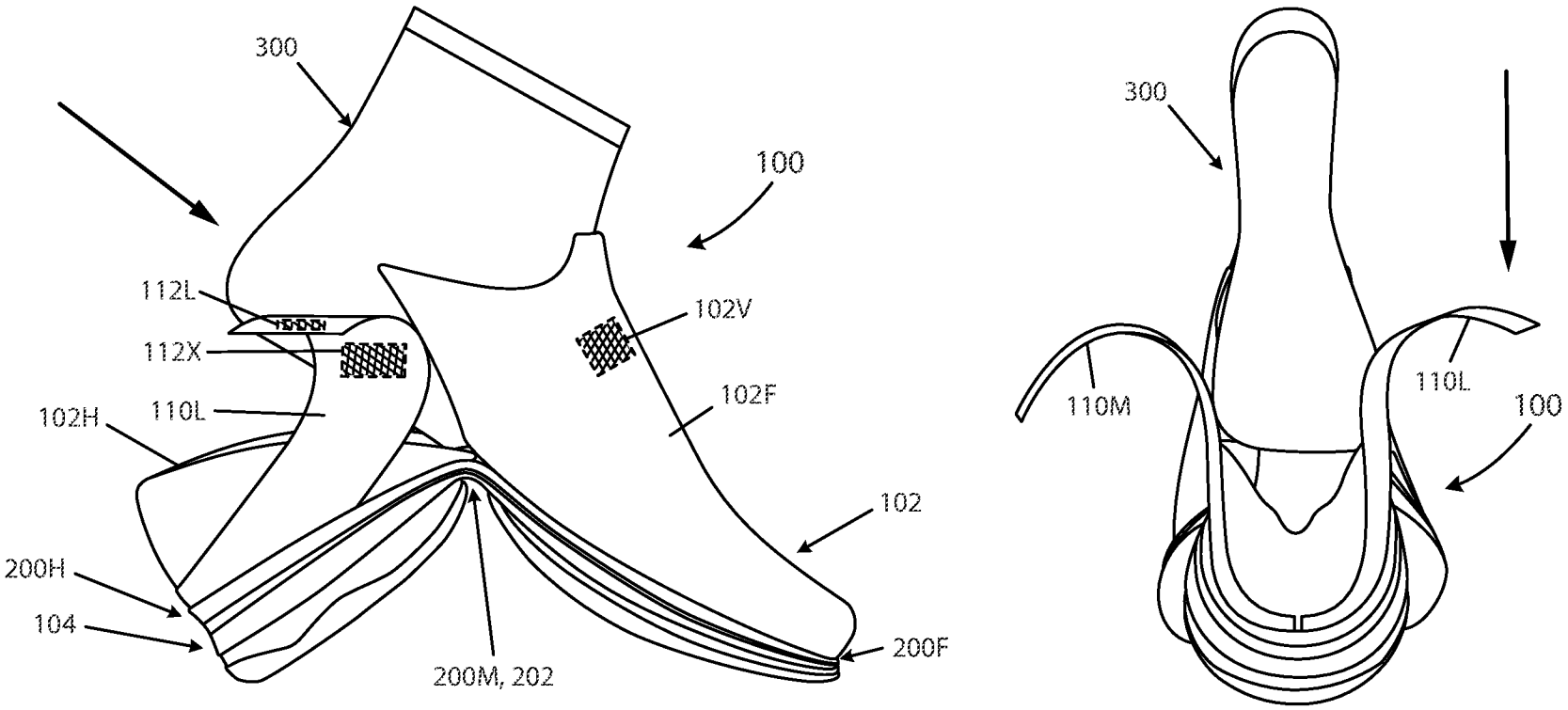

In the position/configuration of FIGS. 3A and 3B, the article of footwear 100 is ready to receive a wearer's foot 300, e.g., as shown in FIG. 3C. Optionally, foot 300 insertion may take place in a "hands-free" manner. More specifically, with hands unnecessary (e.g., the footwear 100 may be designed so that the toe and heel shapes allow the footwear 100 to balance and stand upright unaided on a substantially horizontal support surface (e.g., in the arrangement shown in FIGS. 3A-3C)), the user slides their foot 300 into the forefoot upper component 102F (e.g., into the vamp piece) with toe down and heel up. Upon stepping into the footwear (FIG. 3D) and onto the ground (FIG. 3E), the midfoot flex component 200M, at the arch/shank, flexes from the weight of/force applied by the user into a longitudinally straight configuration (e.g., into the closed position/foot securing configuration of FIG. 2A or 2D and 3E). Simultaneously, the heel upper component 102H automatically rotates/pivots upward and the heel counter (included as part of heel upper component 102H) wraps around or contains the user's heel (e.g., the upper 102 closes around the wearer's foot 300 about the flex component 200M in a "clam shell" type manner). Movement of the midfoot flex component 200M between the open position (FIG. 3D) and the closed position (FIG. 3E) may be accompanied by an audible sound (e.g., a "click"), e.g., as a bi-stable spring element (or hinge) snaps between its two stable positions. As shown by a comparison of FIGS. 3A and 3E, movement of the midfoot flex component 200M (e.g., the bi-stable spring elements between the closed position and the open position (e.g., between the first stable configuration and the second stable configuration of the bi-stable spring element) changes an angle of the forefoot ground-contacting surface of the forefoot outsole component 208F relative to the heel ground-contacting surface of the heel outsole component 208H.

Figure 3E:
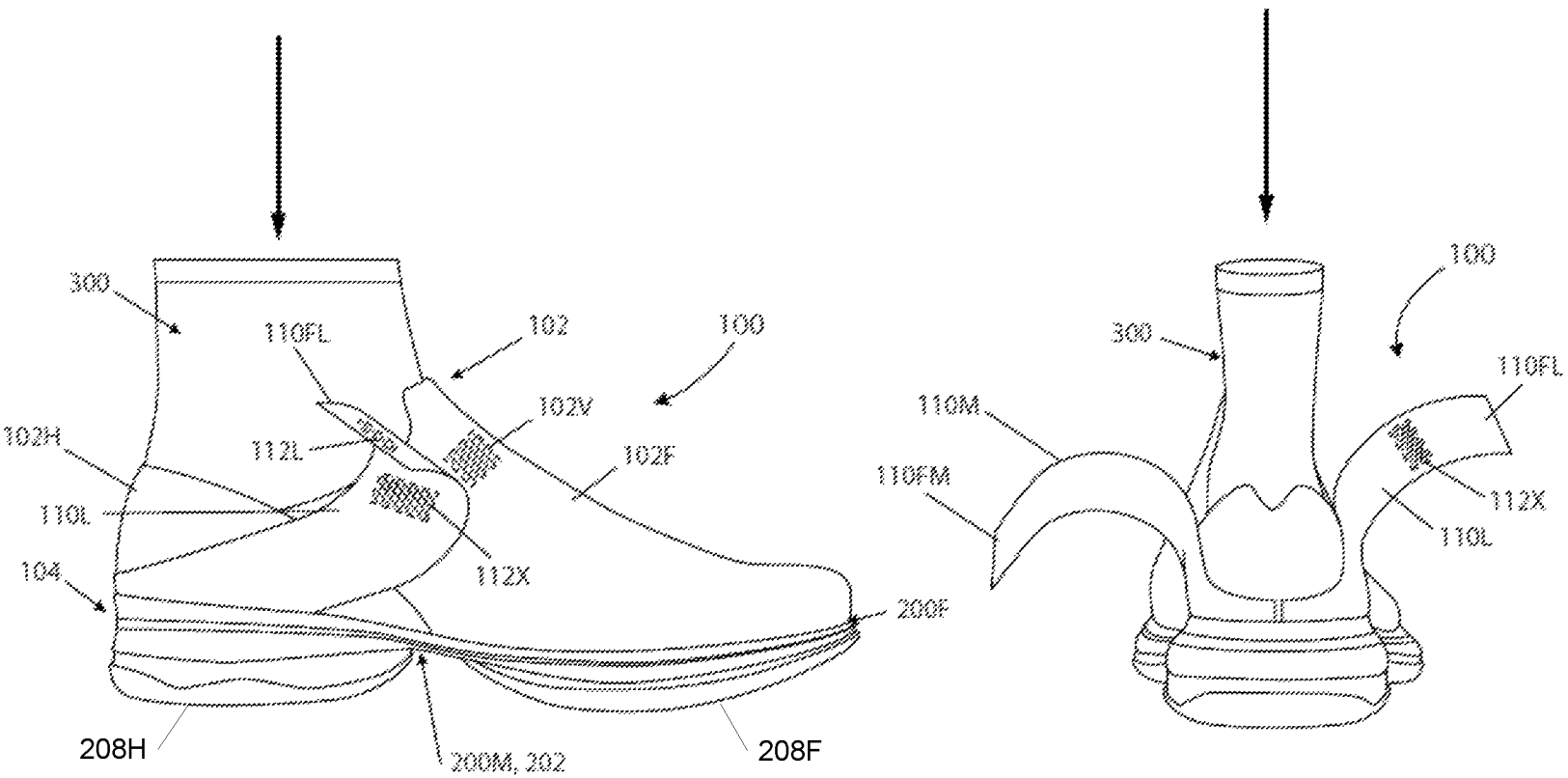
Figure 3F:
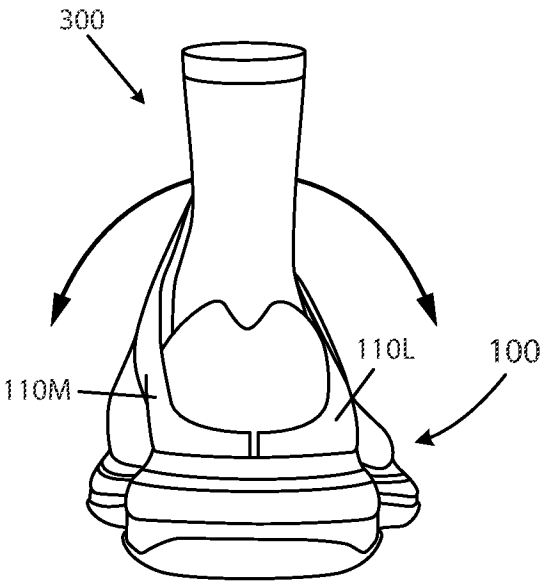
Figure 3F:
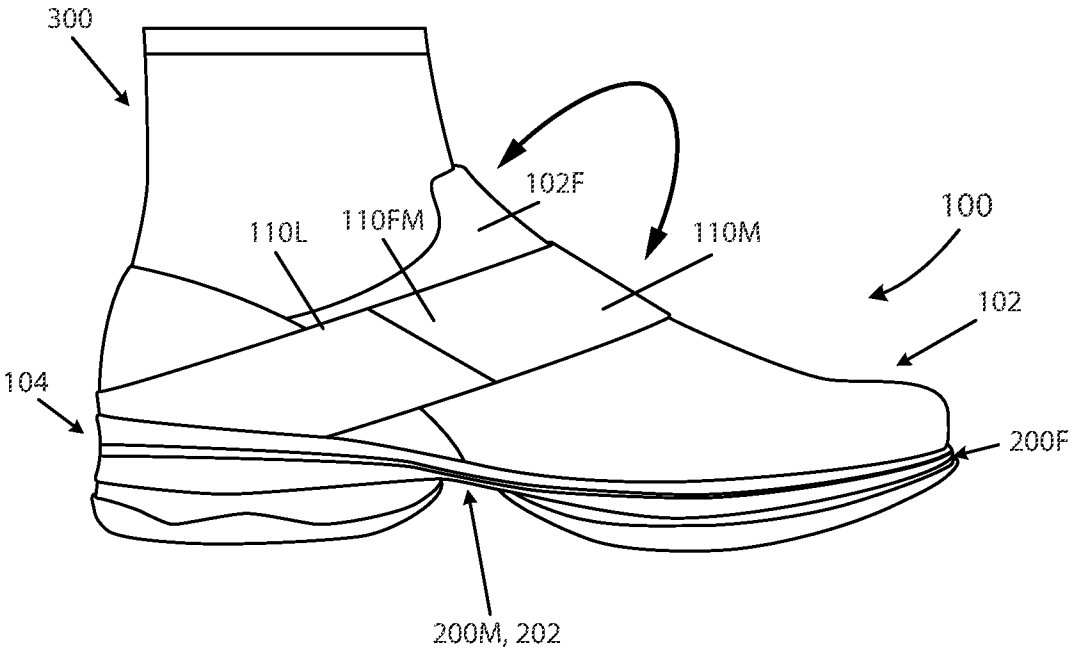
Figure 4A:
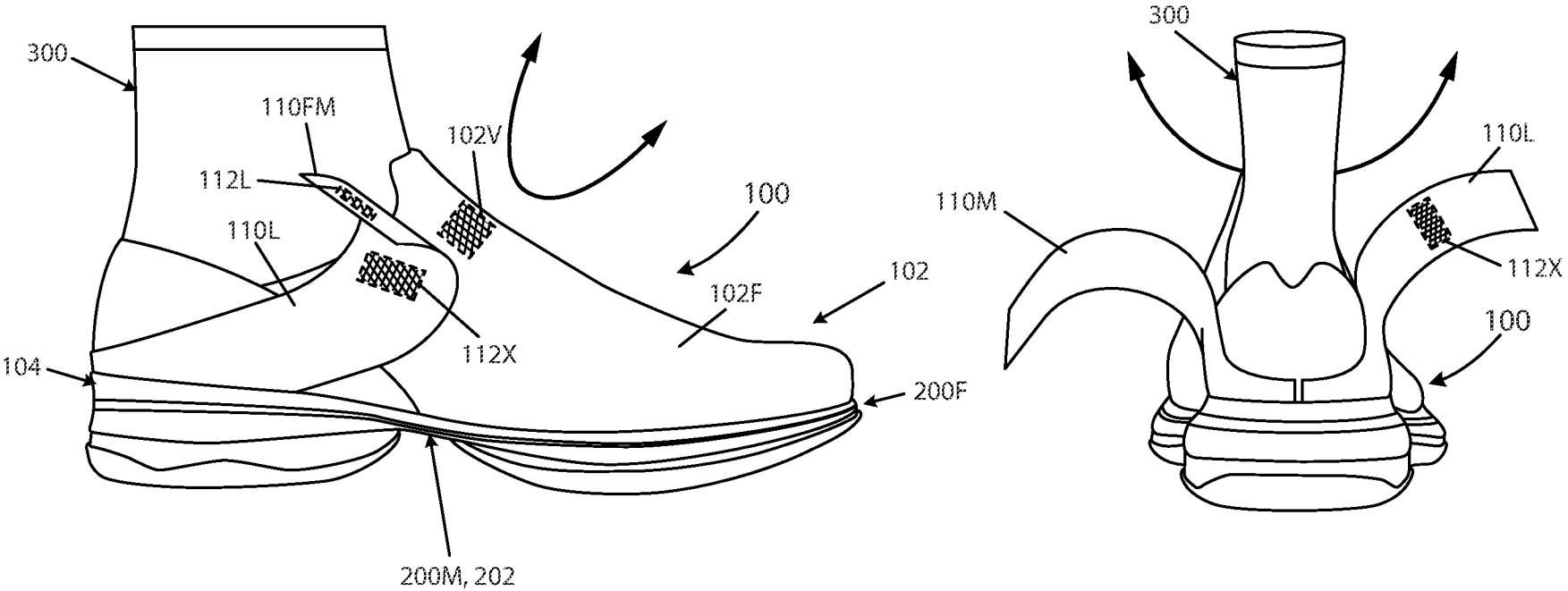
FIGS. 4A through 4C illustrate features of a footwear removal process for articles of footwear in accordance with some aspects of this invention.
Figure 4B:
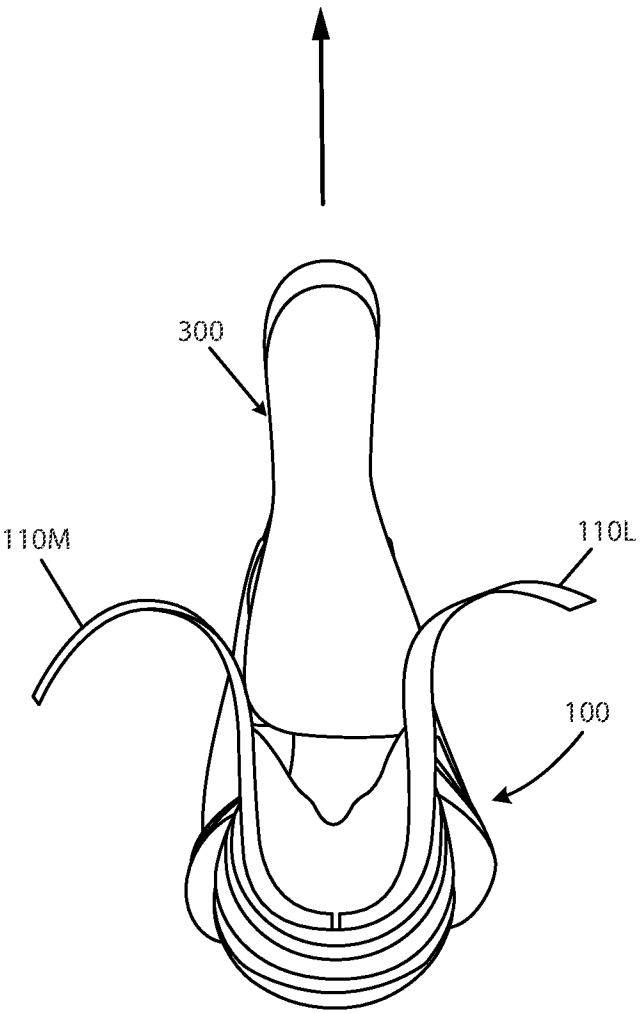
Figure 4B:
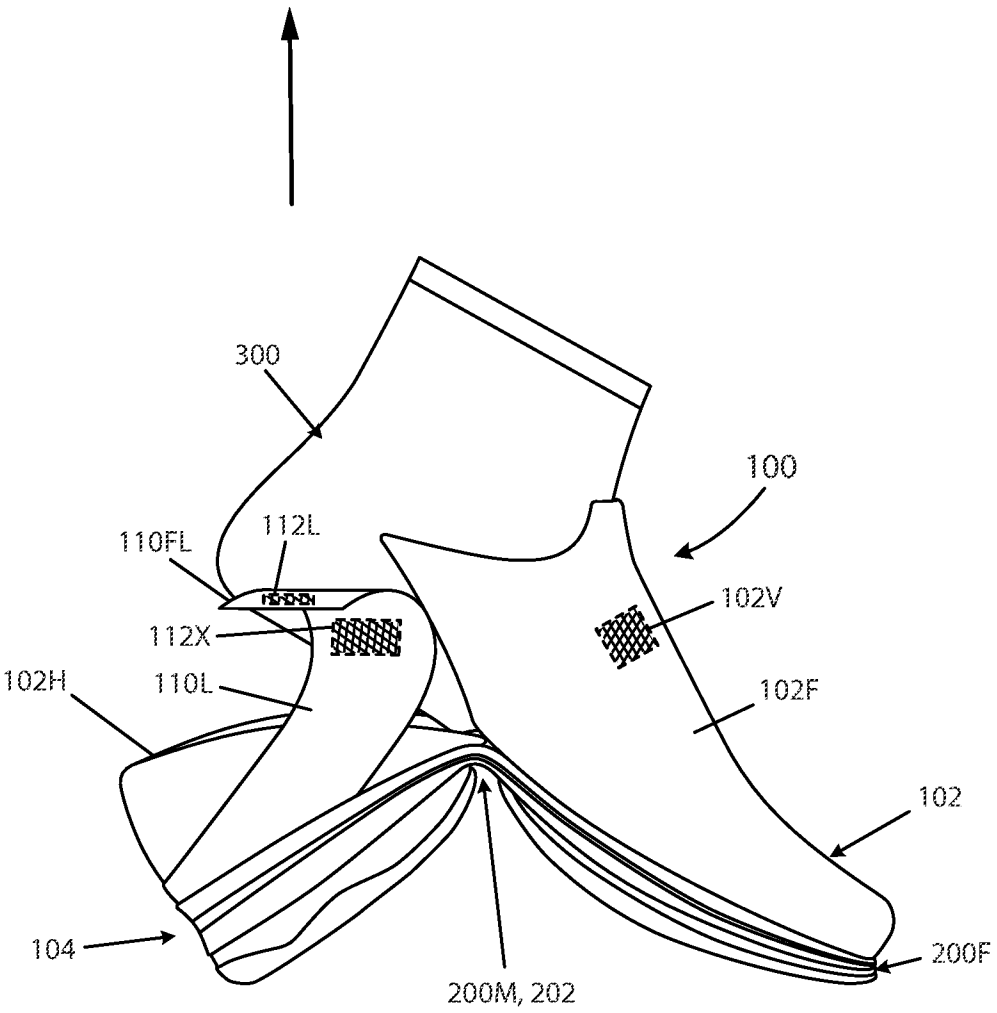
Figure 4C:
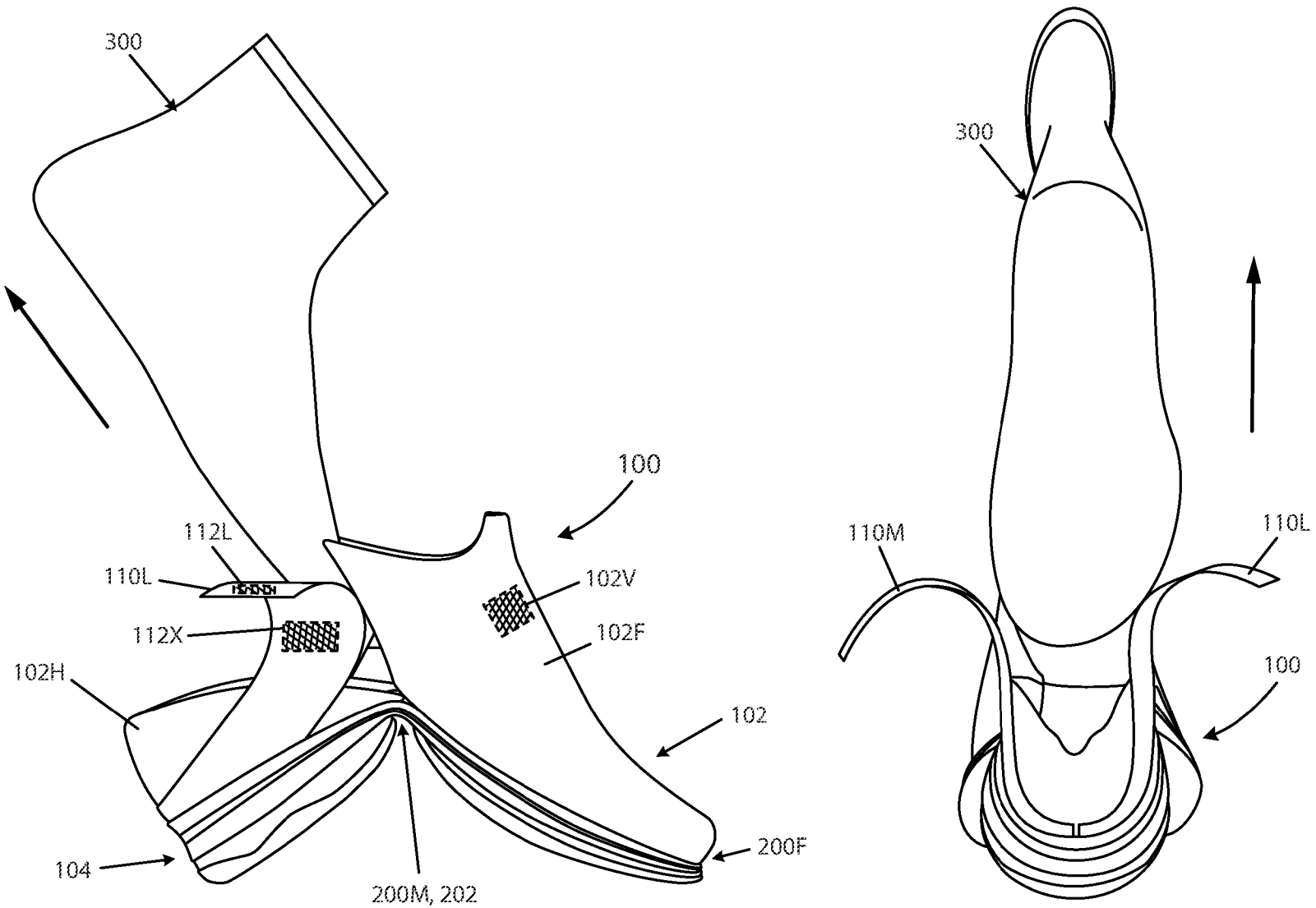

From the arrangement shown in FIG. 3E, the user then grasps the free end 110FL of lateral strap portion 110L, pulls it tight around the lateral side and across forefoot upper component 102F, and engages its interior hook-and-loop fastener component 112L with the hook-and-loop fastener 102V provided on the forefoot upper component 102F (at the vamp/instep area of the upper 102). The user then grasps the free end 110FM of medial strap portion 110M, pulls it tight around the medial side and across forefoot upper component 102F, and engages its interior hook-and-loop fastener component 112M with the exterior hook-and-loop fastener component 112X provided on the exterior surface of lateral strap portion 110L and/or heel upper component 102H (e.g., in the lateral side heel area of one or both of these components). See FIG. 3F. In this manner, the strap portions 110L/110M wrap around the rear and bottom heel areas of the wearer's foot 300 and around the ankle areas of a wearer's foot to securely (and releasably) hold the wearer's foot 300 in the article of footwear 100. Once in the configuration shown in FIG. 3F, the midfoot flex component 200M (e.g., a bi-stable spring element) can hold the sole structure 104 in the stable, foot supporting configuration (without external forces applied to it).

To remove the footwear 100 from the wearer's foot 300, the user reverses the insertion procedure described above. More specifically, the user first releases the medial strap portion 110M from the lateral strap portion 110L by pulling on the medial strap portion 110M (dislodging fastener component 112M from fastener component 112X), releases the lateral strap portion 110L from the vamp portion (FIG. 4A) (dislodging fastener component 112L from fastener component 102V), and lifts his/her foot upward (e.g., off of the ground). In at least some examples of this invention, as the foot is lifted upward (FIG. 4B), the foot support component 200 (e.g., the midfoot flex component 200M) will automatically revert to its open position/foot insertion or removal configuration in a "hands free" manner when sufficient weight/force is removed from plantar support surface (s) 200HS and/or 200FS (i.e., without the user physically forcing the midfoot flex component 200M to change from the closed position/foot supporting configuration to the open position/foot insertion or removal configuration). This action rotates/pivots the heel upper component 102H away from the wearer's heel, and the user then can easily remove the footwear 100 in a "hands free" manner. Once the foot is removed (FIG. 4C), the footwear 100/sole structure 104/foot support component 200/midfoot flex component 200M is/are stably held at the open position/foot insertion or removal configuration. Movement of the midfoot flex component 200M between the closed position (FIG. 4A) and the open position (FIG. 4B) may be accompanied by an audible sound (e.g., a "click"), e.g., as a bi-stable spring element (or hinge) snaps between its two stable positions.

To facilitate this "automatic" reversion to its open position/foot insertion or removal configuration as described above, the midfoot flex component 200M may be a spring type component under an applied force in the closed position and biased to move to the open position/foot insertion or removal configuration when no external forces (or insufficient external forces) are applied to hold it in the closed position/foot supporting configuration. When the user's foot 300 is in the footwear, the securing strap 110 and the user's weight may be sufficient to stably hold the midfoot flex component 200M in its closed position/foot supporting configuration against the biasing force. Additionally or alternatively, if desired (e.g., if the midfoot flex component 200M includes a bi-stable spring element), the article of footwear 100 (e.g., the sole structure 104) may include an independent spring or an independently operated switch that would apply a force to the foot support component 200 (e.g., to the midfoot flex component 200M) and cause it to rotate/pivot from the closed position/foot supporting configuration to the open position/foot insertion or removal configuration. Examples of such systems are described, for example, in U.S. Provisional Patent Appln. No. 62/412,956 filed Oct. 26, 2016 entitled "Easy Access Articles of Footwear," which application is entirely incorporated herein by reference. As yet another option or alternative, if desired, the user could move the heel upper component 102H with respect to the forefoot upper component 102F (e.g., cause pivotal motion or rotation about midfoot flex component 200M) to get the change from the closed position/foot supporting configuration to the open position/foot insertion or removal configuration started (e.g., for midfoot flex components 200M formed with or to include bi-stable spring elements/hinges). The user may accomplish this using his/her hand, other foot, an external device, etc., to apply force to rotate the heel of the footwear relative to the forefoot of the footwear (e.g., the switch from the foot supporting configuration to the foot insertion/removal configuration need not occur automatically as the wearer lifts up his/her foot, but the change may be initiated by user action, such as by applying force with the hand(s), other foot, an external device, etc.).

As noted above, for at least some examples of this invention, transition between the open position/foot insertion or removal configuration and the closed position/foot supporting configuration may be accompanied by an audible sound, such as a click, e.g., when a bi-stable spring element/hinge snaps between its two stable positions/states. This "snapping" between the two positions also may be accompanied by a tactile sensation (e.g., a user can "feel" the snap through contact with the upper 102/sole structure 104 on his/her hands and/or feet). This feedback (audible sound, tactile feedback, and/or other proprioceptive feedback) can be comforting or assuring for users, e.g., as they will have audible, tactile, and/or proprioceptive "feedback" indicating and assuring that they have correctly converted the article of footwear 100/sole structure 104/foot support component 200/midfoot flex component 200M to a stable state/position.

FIGS. 5A through 5E provide various views of another example article of footwear 500 in accordance with at least some examples of this invention. In FIGS. 5A-5E, parts having the same or similar features/functions to parts described above in conjunction with FIGS. 1A through 4C will be referred to by the same reference number, and much of the duplicative description will be omitted. The various parts shown in FIGS. 5A-5E may have any of the structures, features, functions, and/or options of the same or similar parts shown in FIGS. 1A-4C and/or the various parts shown in FIGS. 1A-4C may have any of the structures, features, functions, and/or options of the same or similar parts shown in FIGS. 5A-5E.

In the example footwear structure 500 of FIGS. 5A-5E, the sole structure 104 includes a heel based impact force attenuating component 504H and a separate forefoot based impact force attenuating component 504F. These impact force attenuating components 504H/504F may be made from the same or different materials and/or constructions, and in this illustrated example constitute foam midsole components, e.g., formed from polyurethane foams, ethylvinylacetate foams, or other desired materials. The heel based impact force attenuating component 504H may be engaged with a heel based outsole component 208H, e.g., which may be of the various types described above. Similarly, forefoot based impact force attenuating component 504F may be engaged with a forefoot based outsole component 208F, which also may be of the various types described above. The heel based impact force attenuation component 504H/heel based outsole component 208H form a separate heel support "pod" from the forefoot support "pod" that includes forefoot based impact force attenuation component 504F/forefoot based outsole component 208F.

The heel support "pod" and the forefoot support "pod" of this example are engaged by midfoot flex component 200M, which in this illustrated example includes a bi-stable spring element or hinge of the various types described above (with two stable positions/configurations and including a rigid plate 202 transitional between an open position and a closed position). As shown in FIG. 5B, the midfoot flex component 200M extends across the midfoot/arch/shank area of the sole structure 104 in a longitudinal direction (heel-to-toe direction) of the sole structure 104/article of footwear 500. The midfoot flex component 200M may be a separate component engaged with at least one portion of the heel support "pod" and the forefoot support "pod," or it may be integrally formed with one or more "pod" parts. In some examples of the invention, the midfoot flex component 200M will be integrally formed with at least a portion of heel support component 200H and/or at least a portion of forefoot support component 200F, e.g., by a molding process (e.g., injection molding), but only the arch/shank portion of that integrally formed component will be shaped to function as the midfoot flex component 200M (e.g., formed as a bi-stable spring element or hinge over a 0.5 to 6 inch longitudinal length of its structure). As a more specific example, only a portion of the overall integrally formed structure will be shaped and constructed as a bi-stable spring element or hinge and/or otherwise shaped to provide flex at the desired midfoot location.

The securing strap 110 arrangement of FIGS. 5A-5E also differs from those described above in conjunction with FIGS. 1A-4C. In this illustrated example footwear structure 500, lateral strap portion 110L includes securing fastener component 112L that engages a lateral securing fastener component 510L provided on the lateral side of forefoot upper component 102F (e.g., the fastener components 112L and 510L may include portions of a hook-and-loop type fastener or other releasable fastener structure). Similarly, if desired, medial strap portion 110M includes securing fastener component 112M that engages a medial securing fastener 510M provided on the medial side of forefoot upper component 102F. The strap portions 110L/110M of this example do not engage one another and do not cross the front vamp/instep portion of the forefoot upper component 102F from one side to the other. As illustrated in these figures, if desired, the strap portions 110L/110M of this example further include eyelet openings, e.g., available to engage a conventional footwear lace construction, if desired.

Figure 5A:
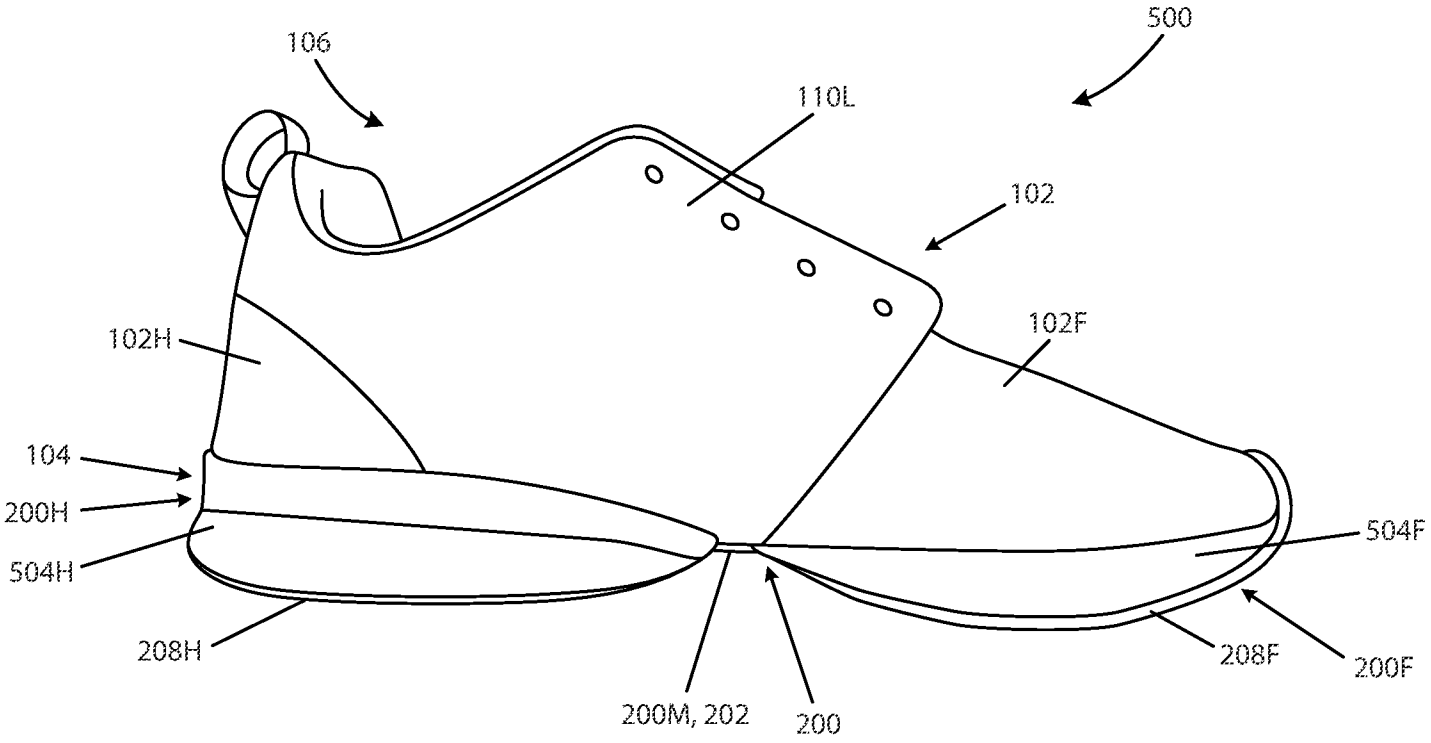
FIGS. 5A through 5E provide various views of another article of footwear in accordance with at least some examples of this invention.
Figure 5B:
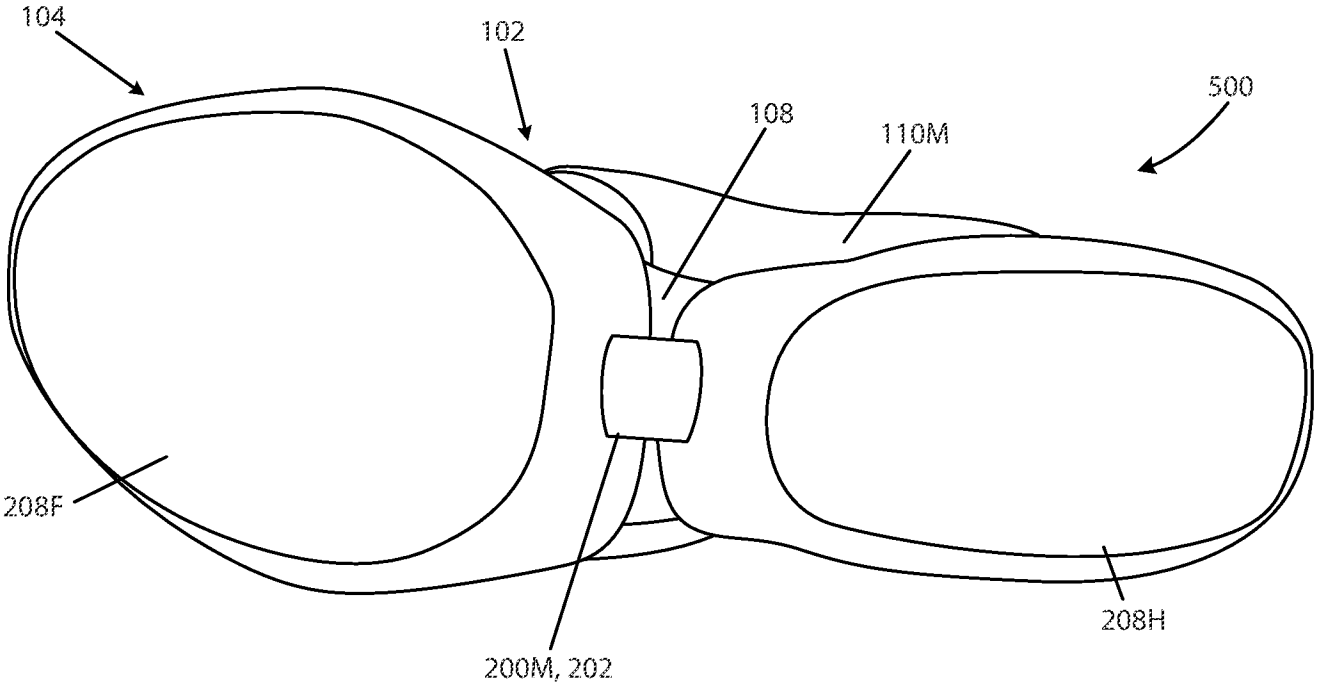
Figure 5C:
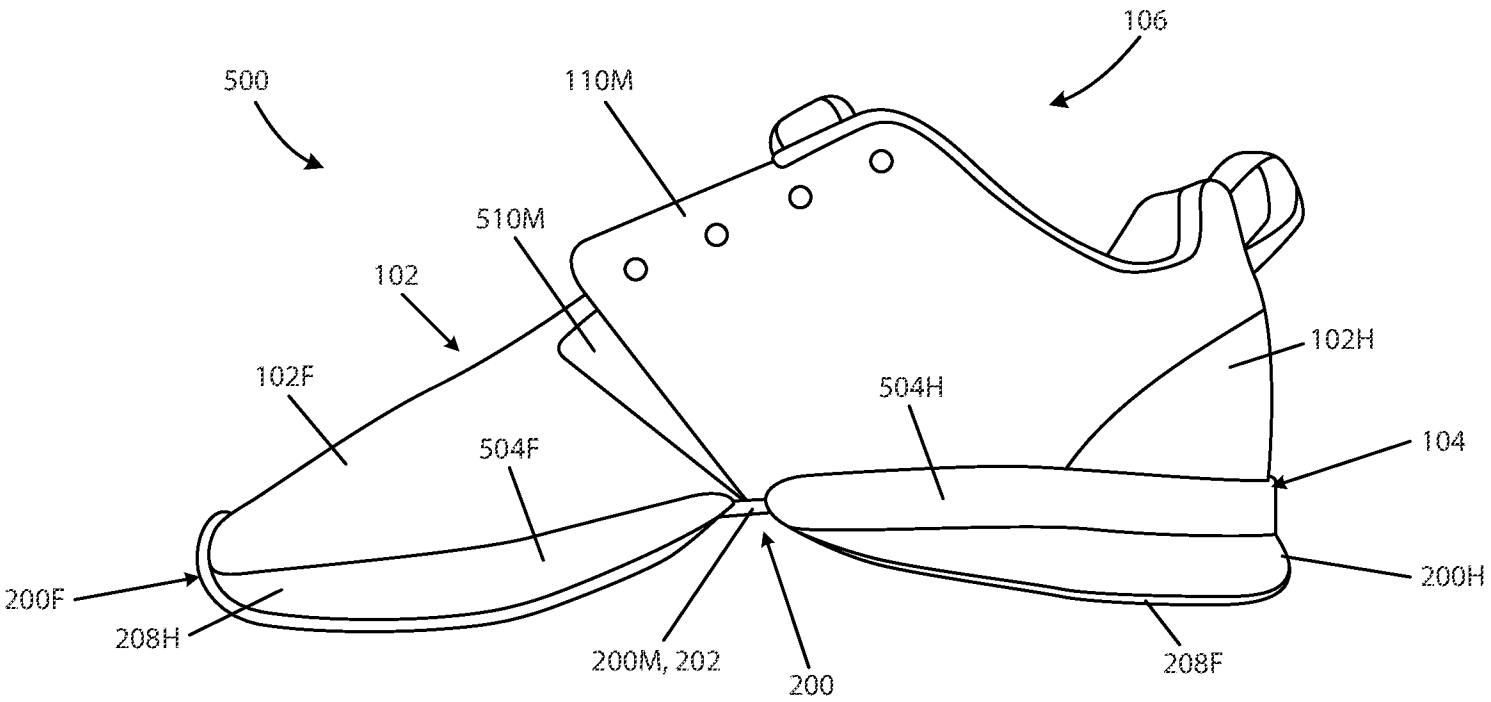
Figure 5E:
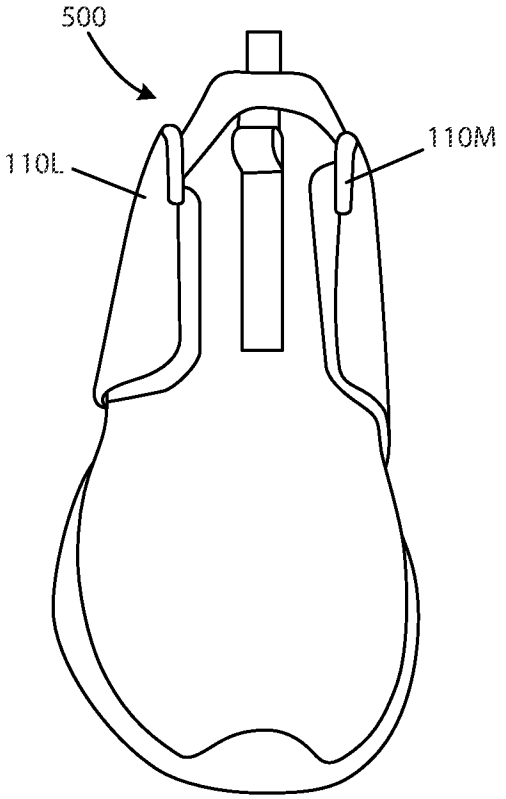
Figure 5D:
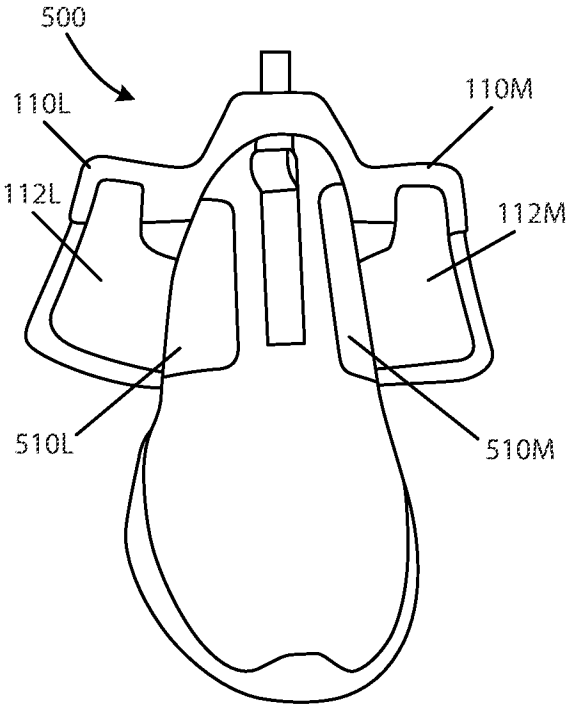

FIG. 5A illustrates this example article of footwear 500 with the midfoot flex component 200M/foot support structure 200/sole structure 104/article of footwear 500 in the closed position/foot supporting configuration. FIG. 5C, on the other hand, illustrates this example article of footwear 500 with the midfoot flex component 200M/foot support structure 200/sole structure 104/article of footwear 500 in the open position/foot insertion or removal configuration. With the midfoot flex component 200M/foot support structure 200/sole structure 104/article of footwear 500 in the open position/foot insertion or removal configuration and the strap members 110M/110L in an unengaged state, e.g., as shown in FIGS. 5C and 5D, a user can insert his/her foot into the article of footwear 500, e.g., in the general manner described above in conjunction with FIGS. 3A-3F. When the foot is inserted and presses down to convert the midfoot flex component 200M/foot support structure 200/sole structure 104/article of footwear 500 to the closed position/foot supporting configuration shown in FIG. 5A (with corresponding audible, tactile, and/or proprioceptive feedback as described above when the midfoot flex component 200M snaps between its two stable states/configurations), the strap portions 110L and 110M can be secured (engaging fastener component 112L with fastener component 510L and engaging fastener component 112M with fastener component 510M) to securely hold the foot in place. A conventional lace also can be tied, if provided/desired.

Removal of the shoe requires untying a lace, if provided, and then: (a) disengagement of fastener component 112L from fastener component 510L; (b) disengagement of fastener component 112M from fastener component 510M; and (c) movement (e.g., rotation/pivot) of the heel support pod downward with respect to the forefoot support pod about midfoot flex component 200M (optionally manually with the user's hands or other foot) to convert the midfoot flex component 200M/foot support structure 200/sole structure 104/article of footwear 500 from the closed position/foot supporting configuration shown in FIG. 5A to the open position/foot insertion (or removal) configuration as shown in FIG. 5C (with corresponding audible, tactile, and/or proprioceptive feedback as described above when the midfoot flex component 200M snaps between its two stable states/configurations). With the footwear 500 then opened, the foot can be removed, e.g., as described above.

Features of the various embodiments of the invention can be used with other embodiments without departing from this invention. For example, if desired, the strap construction and securing mechanisms described above with respect to FIGS. 1A-4C can be used in the footwear structures of FIGS. 5A-5E and/or the strap construction and securing mechanisms described above with respect to FIGS. 5A-5E can be used in the footwear structures of FIGS. 1A-4C. As another option or example, the sole structures 104 described above with respect to FIGS. 1A-4C can be used in the footwear structures of FIGS. 5A-5E and/or the sole structures described above with respect to FIGS. 5A-5E can be used in the footwear structures of FIGS. 1A-4C. Other "mixing" and "matching" of various component parts from the various embodiments may occur without departing from this invention.

III. Conclusion

Aspects and features of the present invention are disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

As some more specific examples, aspects of this invention relate at least to the subject matter described in the following numbered items:

Item 1. A sole structure for an article of footwear, comprising:

a forefoot support component;

a heel support component; and a midfoot flex component engaging the forefoot support component and the heel support component, wherein the midfoot flex component includes a medial side edge, a lateral side edge, and an intermediate portion extending between the lateral side edge and the medial side edge, and wherein the midfoot flex component is movable between a closed position and an open position, wherein:

in the closed position, at least a portion of the midfoot flex component has a transverse cross sectional shape extending in a direction from the medial side edge to the lateral side edge in which the intermediate portion of the midfoot flex component curves in a first direction from a local extrema located in the intermediate portion, and in the open position, at least said portion of the midfoot flex component has a transverse cross sectional shape extending in the direction from the medial side edge to the lateral side edge in which the intermediate portion of the midfoot flex component is substantially flat or curves in a second direction from a local extrema located in the intermediate portion, wherein the second direction is opposite from the first direction.

Item 2. The sole structure according to item 1, wherein the midfoot flex component includes a bi-stable spring element.

Item 3. The sole structure according to item 1, wherein the midfoot flex component includes a first end, a second end, and an intermediate portion extending between the first end and the second end, wherein the first end is located closer to the heel support component than is the second end, wherein the second end is located closer to the forefoot support component than is the first end, wherein in the closed position, the intermediate portion extends in a substantially linear direction in a direction from the first end toward the second end, and wherein in the open position, the intermediate portion is curved in the direction from the first end toward the second end.

Item 4. A sole structure for an article of footwear, comprising:

a forefoot support component;

a heel support component; and a midfoot component engaging the forefoot support component and the heel support component, wherein the midfoot component includes a bi-stable spring element movable between a first stable configuration and a second stable configuration, wherein:

in the first stable configuration, the bi-stable spring element holds the sole structure in a foot supporting configuration, and in the second stable configuration, the bi-stable spring element holds the sole structure in a foot insertion or removal configuration.

Item 5. The sole structure according to item 4, wherein in the first stable configuration, the bi-stable spring element has a transverse cross sectional shape curving in a first direction from a local extrema located in an intermediate portion of the bi-stable spring element, and wherein in the second stable configuration, the bi-stable spring element has a transverse cross sectional shape that is substantially flat or curved in a second direction from a local extrema located in the intermediate portion, wherein the second direction is opposite from the first direction.

Item 6. The sole structure according to item 4, wherein the bi-stable spring element includes a first end, a second end, and an intermediate portion extending between the first end and the second end, wherein the first end is located closer to the heel support component than is the second end, wherein the second end is located closer to the forefoot support component than is the first end, wherein in the first stable configuration, the intermediate portion extends in a substantially linear direction in a direction from the first end toward the second end, and wherein in the second stable configuration, the intermediate portion is curved in the direction from the first end toward the second end.

Item 7. The sole structure according to any preceding item, wherein the forefoot support component includes a forefoot foam member, and/or wherein the heel support component includes a heel foam member.

Item 8. The sole structure according to any preceding item, wherein: (a) the forefoot support component includes a forefoot fluid-filled bladder element, (b) the heel support component includes a heel fluid-filled bladder element, and/or (c) the heel fluid-filled bladder element is a separate component from the forefoot fluid-filled bladder element.

Item 9. The sole structure according to any one of items 1 through 6, wherein the forefoot support component includes a forefoot impact force attenuating component, and/or wherein the heel support component includes a heel impact force attenuating component.

Item 10. The sole structure according to any one of items 1 through 6, wherein the forefoot support component includes an upper forefoot support portion defining a forefoot plantar support surface and a lower forefoot support portion located below the upper forefoot support portion; and/or wherein the heel support component includes an upper heel support portion defining a heel plantar support surface and a lower heel support portion located below the upper heel support portion.

Item 11. The sole structure according to any preceding item, further comprising:

a forefoot outsole component engaged with the forefoot support component, and/or a heel outsole component engaged with the heel support component.

Item 12. The sole structure according to item 11, wherein the heel outsole component is a separate component from the forefoot outsole component.

Item 13. The sole structure according to item 10, further comprising:

a forefoot fluid-filled bladder element engaged with the lower forefoot support portion of the forefoot support component, and/or a heel fluid-filled bladder element engaged with the lower heel support portion of the heel support component.

Item 14. The sole structure according to item 13, wherein the forefoot fluid-filled bladder element is a separate part from the heel fluid-filled bladder element.

Item 15. The sole structure according to item 13 or item 14, further comprising:

a forefoot outsole component engaged with the forefoot fluid-filled bladder element, and/or a heel outsole component engaged with the heel fluid-filled bladder element.

Item 16. An article of footwear, comprising:

an upper; and a sole structure according to any one of the preceding items engaged with the upper.

Item 17. The article of footwear according to item 16, wherein the upper includes a forefoot upper component engaged with the forefoot support component and/or a heel upper component engaged with the heel support component.

Item 18. The article of footwear according to item 17, wherein the forefoot upper component is not fixedly or rigidly engaged directly with the heel upper component.

Item 19. The article of footwear according to item 18, wherein the forefoot upper component includes a lateral rear end and a medial rear end, wherein the heel upper component includes a lateral forward end and a medial forward end, and wherein:

in the closed position or the foot supporting configuration, at least a portion of the lateral rear end is covered by the lateral forward end and at least a portion of the medial rear end is covered by the medial forward end, and in the open position or the foot insertion or removal configuration, the lateral rear end and the medial rear end are exposed.

Item 20. The article of footwear according to item 18, wherein the forefoot upper component includes a lateral rear end and a medial rear end, wherein the heel upper component includes a lateral forward end and a medial forward end, and wherein:

in the closed position or the foot supporting configuration, at least a portion of the lateral rear end overlaps with the lateral forward end and at least a portion of the medial rear end overlaps with the medial forward end, and/or in the open position or the foot insertion or removal configuration, the lateral rear end does not overlap with the lateral forward end and the medial rear end does not overlap with the medial forward end.

Item 21. The article of footwear according to any one of items 17 through 20, wherein the upper further includes a securing strap fixedly engaged with at least one of the heel upper component or the heel support component.

Item 22. The article of footwear according to item 21, wherein the securing strap includes a first free end, a second free end, and an intermediate portion extending between the first free end and the second free end, and wherein at least a portion of the intermediate portion of the securing strap is fixedly engaged with at least one of the heel upper component or the heel support component.

Item 23. The article of footwear according to item 21, wherein the securing strap includes a lateral strap portion and a medial strap portion, and wherein at least one of the lateral strap portion and the medial strap portion releasably engages the forefoot upper component.

Item 24. The article of footwear according to item 21, wherein the securing strap includes a lateral strap portion and a medial strap portion, and wherein the lateral strap portion is releasably engaged with the medial strap portion.

What is claimed is:

1. An article of footwear, comprising:

an upper; and a sole structure engaged with the upper, wherein the sole structure includes:

a forefoot support component, a forefoot outsole component engaged with the forefoot support component, the forefoot outsole component including a forefoot ground-contacting surface, a heel support component, a heel outsole component engaged with the heel support component, the heel outsole component including a heel ground-contacting surface, and a midfoot component engaging the forefoot support component and the heel support component, wherein the midfoot component includes: (a) a medial side edge, (b) a lateral side edge, (c) an intermediate portion extending between the lateral side edge and the medial side edge, (d) a first end, (e) a second end, and (f) a front-to-back intermediate portion extending from the first end to the second end in a longitudinal direction of the sole structure, and wherein the midfoot component includes a bi-stable spring element movable between a first stable configuration and a second stable configuration, wherein:

in the first stable configuration, the bi-stable spring element holds the sole structure in a foot supporting configuration such that the front-to-back intermediate portion extends in a substantially linear direction in a direction from the first end toward the second end, and in the second stable configuration, the bi-stable spring element holds the sole structure in a foot insertion or removal configuration such that the front-to-back intermediate portion is curved in the direction from the first end toward the second end, and wherein movement of the bi-stable spring element between the first stable configuration and the second stable configuration changes an angle of the forefoot ground-contacting surface relative to the heel ground-contacting surface.

2. The article of footwear according to claim 1, wherein the heel outsole component is a separate component from the forefoot outsole component.

3. The article of footwear according to claim 1, wherein the upper includes a forefoot upper component engaged with the forefoot support component and a heel upper component engaged with the heel support component, wherein the upper comprises a clamshell configuration in which the heel upper component and the forefoot upper component are configured to move with respect to one another to open and close about the midfoot component.

4. The article of footwear according to claim 1, wherein the upper includes a forefoot upper component engaged with the forefoot support component and a heel upper component engaged with the heel support component, wherein when switching from the second stable configuration to the first stable configuration: (i) the midfoot component flexes into a longitudinally straight configuration, (ii) the heel upper component automatically pivots upward, and (iii) a heel counter of the heel upper component is positioned and configured to wrap around or contain a heel of a wearer of the article of footwear.

5. The article of footwear according to claim 1, wherein the upper includes a forefoot upper component engaged with the forefoot support component and a heel upper component engaged with the heel support component, wherein the forefoot upper component is not fixedly or rigidly engaged directly with the heel upper component.

6. The article of footwear according to claim 5, wherein the forefoot upper component includes a lateral rear end and a medial rear end, wherein the heel upper component includes a lateral forward end and a medial forward end, and wherein:

in the foot supporting configuration, at least a portion of the lateral rear end is covered by the lateral forward end and at least a portion of the medial rear end is covered by the medial forward end, and in the foot insertion or removal configuration, the lateral rear end and the medial rear end are exposed.

7. The article of footwear according to claim 5, wherein the forefoot upper component includes a lateral rear end and a medial rear end, wherein the heel upper component includes a lateral forward end and a medial forward end, and wherein:

in the foot supporting configuration, at least a portion of the lateral rear end overlaps with the lateral forward end and at least a portion of the medial rear end overlaps with the medial forward end, and/or in the foot insertion or removal configuration, the lateral rear end does not overlap with the lateral forward end and the medial rear end does not overlap with the medial forward end.

8. The article of footwear according to claim 1, wherein the upper includes a forefoot upper component engaged with the forefoot support component and a heel upper component engaged with the heel support component, wherein the upper further includes a securing strap fixedly engaged with at least one of the heel upper component or the heel support component, wherein the securing strap includes a first free end, a second free end, and an intermediate portion extending between the first free end and the second free end, and wherein at least a portion of the intermediate portion of the securing strap is fixedly engaged with at least one of the heel upper component or the heel support component.

9. The article of footwear according to claim 1, wherein the upper includes a forefoot upper component engaged with the forefoot support component and a heel upper component engaged with the heel support component, wherein the upper further includes a securing strap fixedly engaged with at least one of the heel upper component or the heel support component, wherein the securing strap includes a lateral strap portion and a medial strap portion, and wherein at least one of the lateral strap portion and the medial strap portion releasably engages the forefoot upper component.

10. The article of footwear according to claim 1, wherein the upper includes a forefoot upper component engaged with the forefoot support component and a heel upper component engaged with the heel support component, wherein the upper further includes a securing strap fixedly engaged with at least one of the heel upper component or the heel support component, wherein the securing strap includes a lateral strap portion and a medial strap portion, wherein the lateral strap portion is releasably engaged with the medial strap portion, and wherein the lateral strap portion and the medial strap portion are configured to wrap around rear and bottom heel areas of a wearer's foot and around ankle areas of the wearer's foot to securely and releasably hold the wearer's foot in the article of footwear.

11. The article of footwear according to claim 1, wherein movement of the midfoot component between the first stable configuration and the second stable configuration is configured to emit an audible sound as the bi-stable spring element snaps between the first stable configuration and the second stable configuration.

12. An article of footwear, comprising:

an upper; and a sole structure engaged with the upper, wherein the sole structure includes:

a forefoot support component, a forefoot outsole component engaged with the forefoot support component, the forefoot outsole component including a forefoot ground-contacting surface, a heel support component, a heel outsole component engaged with the heel support component, the heel outsole component including a heel ground-contacting surface, and a midfoot flex component engaging the forefoot support component and the heel support component, wherein the midfoot flex component includes a medial side edge, a lateral side edge, and an intermediate portion extending between the lateral side edge and the medial side edge, a first end, a second end, and a front-to-back intermediate portion extending from the first end to the second end in a longitudinal direction of the sole structure, and wherein the midfoot flex component is movable between a closed position and an open position, wherein:

in the closed position, at least a portion of the midfoot flex component has a transverse cross sectional shape extending in a direction from the medial side edge to the lateral side edge in which the intermediate portion of the midfoot flex component curves in a first direction from a local extrema located in the intermediate portion and the front-to-back intermediate portion extends in a substantially linear direction in a direction from the first end toward the second end, and in the open position, at least said portion of the midfoot flex component has a transverse cross sectional shape extending in the direction from the medial side edge to the lateral side edge in which the intermediate portion of the midfoot flex component is substantially flat or curves in a second direction from a local extrema located in the intermediate portion, wherein the second direction is opposite from the first direction and the front-to-back intermediate portion is curved in the direction from the first end toward the second end, and wherein movement of the midfoot flex component between the closed position and the open position changes an angle of the forefoot ground-contacting surface relative to the heel ground-contacting surface.

13. The article of footwear according to claim 12, wherein the upper includes a forefoot upper component engaged with the forefoot support component and a heel upper component engaged with the heel support component, wherein the upper comprises a clamshell configuration in which the heel upper component and the forefoot upper component are configured to move with respect to one another to open and close about the midfoot flex component.

14. The article of footwear according to claim 12, wherein the upper includes a forefoot upper component engaged with the forefoot support component and a heel upper component engaged with the heel support component, wherein when switching between the open position and the closed position: (a) the midfoot flex component flexes into a longitudinally straight configuration, (b) the heel upper component automatically pivots upward, and (c) a heel counter of the heel upper component is positioned and configured to wrap around or contain a heel of a wearer of the article of footwear.

15. The article of footwear according to claim 12, wherein the upper includes a forefoot upper component engaged with the forefoot support component and a heel upper component engaged with the heel support component, wherein the forefoot upper component is not fixedly or rigidly engaged directly with the heel upper component.

16. The article of footwear according to claim 15, wherein the forefoot upper component includes a lateral rear end and a medial rear end, wherein the heel upper component includes a lateral forward end and a medial forward end, and wherein:

in the closed position, at least a portion of the lateral rear end is covered by or overlaps with the lateral forward end and at least a portion of the medial rear end is covered by or overlaps with the medial forward end, and in the open position, the lateral rear end and the medial rear end are exposed.

17. The article of footwear according to claim 12, wherein the upper includes a forefoot upper component engaged with the forefoot support component and a heel upper component engaged with the heel support component, wherein the upper further includes a securing strap fixedly engaged with at least one of the heel upper component or the heel support component, wherein the securing strap includes a first free end, a second free end, and an intermediate portion extending between the first free end and the second free end, and wherein at least a portion of the intermediate portion of the securing strap is fixedly engaged with at least one of the heel upper component or the heel support component.

18. The article of footwear according to claim 12, wherein the upper includes a forefoot upper component engaged with the forefoot support component and a heel upper component engaged with the heel support component, wherein the upper further includes a securing strap fixedly engaged with at least one of the heel upper component or the heel support component, wherein the securing strap includes a lateral strap portion and a medial strap portion, and wherein at least one of the lateral strap portion and the medial strap portion releasably engages the forefoot upper component.

19. The article of footwear according to claim 12, wherein the upper includes a forefoot upper component engaged with the forefoot support component and a heel upper component engaged with the heel support component, wherein the upper further includes a securing strap fixedly engaged with at least one of the heel upper component or the heel support component, wherein the securing strap includes a lateral strap portion and a medial strap portion, wherein the lateral strap portion is releasably engaged with the medial strap portion, and wherein the lateral strap portion and the medial strap portion are configured to wrap around rear and bottom heel areas of a wearer's foot and around ankle areas of the wearer's foot to securely and releasably hold the wearer's foot in the article of footwear.

20. The article of footwear according to claim 12, wherein movement of the midfoot flex component between the open position and the closed position is configured to emit an audible sound as the midfoot flex component snaps between the open position and the closed position.

* * * * *